US008476545B2

(12) United States Patent
Sommer et al.

(10) Patent No.: US 8,476,545 B2
(45) Date of Patent: Jul. 2, 2013

(54) SORTING PIECES OF MATERIAL BASED ON PHOTONIC EMISSIONS RESULTING FROM MULTIPLE SOURCES OF STIMULI

(75) Inventors: Edward J. Sommer, Nashville, TN (US); David B. Spencer, Bedford, MA (US); R. Lynn Conley, Nashville, TN (US); Richard E. Hill, Nashville, TN (US); Robert H. Parrish, Nashville, TN (US); Charles E. Roos, Nashville, TN (US)

(73) Assignee: Spectramet, LLC, Bedford, MA (US)

( * ) Notice: Subject to any disclaimer, the term of this patent is extended or adjusted under 35 U.S.C. 154(b) by 153 days.

(21) Appl. No.: 12/826,315

(22) Filed: Jun. 29, 2010

(65) Prior Publication Data

US 2010/0264070 A1 Oct. 21, 2010

Related U.S. Application Data

(63) Continuation of application No. 11/986,830, filed on Nov. 27, 2007, now Pat. No. 7,763,820, which is a continuation of application No. 10/766,298, filed on Jan. 27, 2004, now abandoned.

(60) Provisional application No. 60/442,789, filed on Jan. 27, 2003, provisional application No. 60/442,735, filed on Jan. 27, 2003, provisional application No. 60/464,255, filed on Apr. 21, 2003.

(51) Int. Cl.
*B07C 5/00* (2006.01)

(52) U.S. Cl.
USPC ..... 209/579; 209/38; 209/212; 209/539

(58) Field of Classification Search
USPC ..... 209/38, 44.1, 558, 564, 579, 580; 378/44, 378/45, 47
See application file for complete search history.

(56) References Cited

U.S. PATENT DOCUMENTS 3,903,414 A 9/1975 Herbstein et al.
3,937,953 A 2/1976 Stafford et al.

(Continued)

FOREIGN PATENT DOCUMENTS

CA 702263 A 1/1965
CA 897800 4/1972

(Continued)

OTHER PUBLICATIONS

9266 Alloy Analyzer, Full Library Alloy List (Version S) Alphabetical and Table 4.2A Abbreviated Library Alloy List Alphabetical (2 pages).

(Continued)

*Primary Examiner* — Terrell Matthews
(74) *Attorney, Agent, or Firm* — Wolf, Greenfield & Sacks, P.C.

(57) ABSTRACT

A piece of material that includes low-Z elements is classified based on photonic emissions detected from the piece of material. Both XRF spectroscopy and OES techniques, for example, Laser-Induced Breakdown Spectroscopy (LIBS) and spark discharge spectroscopy, may be used to classify the piece of material. A stream of pieces of material are moved along a conveying system into a stimulation and detection area. Each piece of material, in turn, is stimulated with a first and second stimulus, of a same or different type, causing the piece of material to emit emissions, for example, photons, which may include at least one of x-ray photons (i.e., x-rays) and optical emissions. These emissions then are detected by one or to more detectors of a same or different type. The piece of materials is then classified, for example, using a combination of hardware, software and/or firmware, based on the detected emissions, and then sorted.

75 Claims, 16 Drawing Sheets

U.S. PATENT DOCUMENTS

| | | | | |
|---|---|---|---|---|
| 4,317,521 | A | 3/1982 | Clark et al. | |
| 4,606,760 | A | 8/1986 | Fritz et al. | |
| 4,655,437 | A | 4/1987 | Fritz et al. | |
| 4,767,896 | A | 8/1988 | Nigg et al. | |
| 4,834,870 | A | 5/1989 | Osterberg et al. | |
| 4,848,590 | A | 7/1989 | Kelly | |
| 4,869,811 | A | 9/1989 | Wolanski et al. | |
| 4,884,696 | A | 12/1989 | Peleg | |
| 5,060,871 | A | 10/1991 | Brassinga et al. | |
| 5,236,092 | A | 8/1993 | Krotkov et al. | |
| 5,260,576 | A | 11/1993 | Sommer, Jr. et al. | |
| 5,314,072 | A | 5/1994 | Frankel et al. | |
| 5,418,826 | A * | 5/1995 | Sato et al. | 378/48 |
| 5,424,959 | A | 6/1995 | Reyes et al. | |
| 5,505,313 | A | 4/1996 | Smith et al. | |
| 5,520,290 | A | 5/1996 | Kumar et al. | |
| 5,570,406 | A | 10/1996 | Komatani | |
| 5,628,410 | A | 5/1997 | Smith et al. | |
| 5,663,997 | A | 9/1997 | Willis et al. | |
| 5,676,256 | A | 10/1997 | Kumar et al. | |
| 5,738,224 | A | 4/1998 | Sommer, Jr. et al. | |
| 5,902,177 | A | 5/1999 | Tessier et al. | |
| 5,931,308 | A | 8/1999 | Gesing et al. | |
| 6,005,211 | A | 12/1999 | Huang et al. | |
| 6,118,850 | A * | 9/2000 | Mayo et al. | 378/83 |
| 6,266,390 | B1 | 7/2001 | Sommer, Jr. et al. | |
| 6,421,415 | B1 | 7/2002 | Peczkis et al. | |
| 6,459,767 | B1 | 10/2002 | Boyer | |
| 6,519,315 | B2 | 2/2003 | Sommer, Jr. et al. | |
| 6,545,240 | B2 | 4/2003 | Kumar | |
| 6,753,957 | B1 | 6/2004 | Graft et al. | |
| 6,765,986 | B2 * | 7/2004 | Grodzins et al. | 378/46 |
| 6,801,595 | B2 | 10/2004 | Grodzins et al. | |
| 7,430,273 | B2 * | 9/2008 | Yellepeddi | 378/44 |
| 2004/0066890 | A1 | 4/2004 | Dalmijn et al. | |
| 2004/0252299 | A9 | 12/2004 | Lemmo et al. | |

FOREIGN PATENT DOCUMENTS

| | | | |
|---|---|---|---|
| CA | 923601 | | 3/1973 |
| CA | 1073408 | | 3/1980 |
| EP | 0 096 092 | A1 | 12/1983 |
| EP | 1 724 570 | A1 | 11/2006 |
| EP | 1724570 | A1 * | 11/2006 |
| JP | 08313460 | A | 11/1996 |
| JP | 09-167789 | | 6/1997 |
| JP | 10-216651 | | 8/1998 |
| WO | WO 97/20342 | A1 | 6/1997 |
| WO | WO 98/37436 | A1 | 8/1998 |
| WO | WO 99/61671 | A1 | 12/1999 |
| WO | WO 99/64853 | A1 | 12/1999 |
| WO | WO 01/21317 | A1 | 3/2001 |
| WO | WO 02/50521 | A2 | 6/2002 |
| WO | WO 02/063286 | A2 | 8/2002 |
| WO | WO 02/090955 | A1 | 11/2002 |
| WO | WO 02/103710 | A2 | 12/2002 |
| WO | WO 2008/103571 | A1 | 8/2008 |

OTHER PUBLICATIONS

9277 Metallurgist-XR, Table 1A Alloy Library Categorized List (2 pages).

Appendix from U.S. Patent No. 6,801,595.

Arun Technology, Inc., "Bangs or Bucks" mailer for the Metalscan 1650 and Metalscan 2000 (2 pages).

Arun Technology, Inc., A Roxboro Group Company, "The New Metalsort 1610" order form (1 page).

Asoma Instruments, Inc. PET/PVC Sorter—Model VS-2, (2 pages) (1993).

Asoma Instruments, Inc., "600-Series—On-Line Elemental Analyzers for Continuous Process Quality Control," (5 pages).

"Austin AI's Automated XRF Sorting & Separating System Deemed Best Available Technology for Metals, Plastics & Glass Industries," www.austinai.com, Apr. 8, 2005.

Declaration of David Clifton, signed and dated Jan. 3, 2008.

Declaration of David Clifton, unsigned.

Freifeld, K., "Art Analysis: Probing Beneath the Image," *IEEE Spectrum*, IEEE Inc., pp. 66-71, New York (1986).

Letter from Kirk Teska, Esq. To Innov-X Systems (Redacted) regarding Spectramet patents, dated Nov. 21, 2007, and accompanying Appendix A (24 pages).

Niton Corporation, "Are you losing money selling too many loads of unsorted scrap?" flyer for the Alloy Analyzer (1 page).

Niton Corporation, "Leader in Portable XRF Technology" information booklet regarding the XL-309 Spectrum Analyzer Lead Detector and the 700 series Multi-Element Spectrum Analyzer (8 pages).

Niton Corporation, "Niton Alloy Analyzer" advertisement (2 pages).

Norman F. Johnson, "Replacing antiquated acid spot testing with a portable metal analyzer" *American Laboratory News Edition*, Jun. 1991 (4 pages).

Patent Abstracts of Japan, vol. 1998, No. 13, 30; JP 10 216651 A (Ishikawajima Harima Heavy Ind Co. Ltd) (1998).

"Research Report", Literature search of Computer and Engineering databases; Wolf Greenfield & Sacks P.C., (2006).

Spectro Analytical Instruments, "The Profit Machine" advertisement in *Recycling Today*, p. 69, (1 page).

TN Spectrace, "Alloy Analyzer: Light weight and portable, the TN Alloy Analyzer is a non-destructive, easy-to-use and accurate alloy identification and analysis tool" advertisement (2 sheets) (1992).

TN Spectrace, "Metallurgist® System Specifications," information sheet (1 page).

TN Spectrace, "Power Solutions for Materials Analysis" booklet for Metallurgist® (8 pages).

TN Technologies, "Alloy Analysis" Application Information Form (2 pages) (1997).

Tn Technologies, "Metallurgist Pro: Alloy Analysis and Metal Sorting" advertisement in *Recycling Today*, p. 68 (1 page).

TN Technologies, "Metals Sorting & Analysis" advertisement for the Metallurgist Pro (2 pages).

TN Technologies, "The Metallurgist Pro" advertisement (2 pages) (1998).

Yin L. et al, "A Pattern Recognition Approach in x-ray fluorescence analysis" nuclear Instruments & Methods in Physics Research, Section—A: Accelerators, Spectrometers, Detectors and Associated Equipment, NL, North-Holland Publishing Co., Amsterdam,vol. A277, No. 2/3 + index, 1 pp. 619-626 (1989).

International Search Report and Written Opinion for International Application No. PCT/US2010/001744 mailed Mar. 11, 2011.

Written Opinion for International Application No. PCT/US2010/001744 mailed May 25, 2012.

International Preliminary Report on Patentability for International Application No. PCT/US2010/001744 mailed Aug. 16, 2012.

* cited by examiner

SORTING PIECES OF MATERIAL BASED ON PHOTONIC EMISSIONS RESULTING FROM MULTIPLE SOURCES OF STIMULI

RELATED APPLICATIONS

This application is a continuation of U.S. patent application Ser. No. 11/986,830 (the '830 application), titled SORTING PIECES OF MATERIAL BASED ON PHOTONIC EMISSIONS RESULTING FROM MULTIPLE SOURCES OF STIMULI, filed Nov. 27, 2007. The '830 application is incorporated by reference herein in its entirety. U.S. patent application Ser. No. 11/986,830 in turn is a continuation of U.S. patent application Ser. No. 10/766,298 (the '298 application), titled SORTING PIECES OF MATERIAL BASED ON PHOTONIC EMISSIONS RESULTING FROM MULTIPLE SOURCES OF STIMULI, filed Jan. 27, 2004. The '298 application is incorporated by reference herein in its entirety. U.S. patent application Ser. No. 10/766,298 in turn claims the benefit under 35 U.S.C. §119(e) to commonly-owned U.S. provisional patent application Ser. No. 60/442,789, titled IMPROVED HIGH-SPEED MATERIAL SORTING SYSTEM, filed on Jan. 27, 2003, U.S. provisional patent application Ser. No. 60/442,735, titled SYSTEMS AND METHODS FOR DETECTING ELEMENTS HAVING A LOW ATOMIC NUMBER IN A MASS OF ONE OR MORE MATERIALS AND FOR DETECTING IMPURITIES IN A MOLTEN MASS OF ONE OR MORE MATERIALS, filed on Jan. 27, 2003, and U.S. provisional patent application Ser. No. 60/464,255, titled VARIOUS SYSTEMS AND METHODS FOR HIGH SPEED IDENTIFICATION, CLASSIFICATION, COMPOSITIONAL ANALYSIS AND SORTING OF MATTER AND FOR DETECTING ELEMENTS HAVING A LOW ATOMIC NUMBER, filed on Apr. 21, 2003, each of which is hereby incorporated by reference in its entirety.

GOVERNMENT RIGHTS

The U.S. Government has a paid-up license in this invention and the right in limited circumstances to require the patent owner to license others on reasonable terms as provided for by the terms of Grant Nos. DMI-9901778, DMI-0128048 and DMI-0321298 awarded by National Science Foundation and Grant No. 70NANBOH3044 awarded by the U.S. Department of Commerce as a Cooperative Agreement with the National Institute of Standards and Technology (NIST) under the Advanced Technology Program (ATP).

BACKGROUND

Current worldwide environmental concerns have fueled an increase in efforts to recycle used equipment and articles containing materials that can be reused. Such efforts have produced new and improved processes for sorting materials such as plastics, glasses, metals, and metal alloys.

As used herein, a "material" may be a chemical element, a compound or mixture of two or more chemical elements, or a compound or mixture of a compound or mixture of chemical elements, or any suitable combination thereof, wherein the complexity of a compound or mixture may range from simple to complex. Types of materials include organic materials, metals (ferrous and non-ferrous), metal alloys, plastics, polymers, rubber, glasses, ceramics, fabrics, other materials and any suitable combination thereof. As used herein, "element" means a chemical element of the periodic table of elements, including elements that may be discovered after the filing date of this application.

Generally, methods for sorting pieces of materials involve determining one or more properties, for example, one or more physical and/or chemical properties, of each piece, and grouping together pieces sharing a common property or properties. Such properties may include color, hue, texture, weight, density, transmissivity to light, sound, or other signals, and reaction to stimuli such as various fields. Methods to determine these properties include visual identification of a material by a person, identification by the amount and/or wavelength of the light waves emitted or transmitted (commonly referred to as optical emission spectroscopy or OES), eddy-current separation, heavy-media plant separation, and x-ray fluorescence (XRF) detection.

With respect to metals and metal alloys, today it is neither technically nor commercially feasible to separate and recover many of the non-ferrous metals that are manufactured into products and discarded at the end of their useful life. In residential waste, only aluminum cans are recycled to any significant degree. Virtually none of the other non-ferrous materials in our residential waste are recovered. Instead, they are disposed in landfills. Further, in the U.S., small non-ferrous materials below ⅝ inches (~1.5 cm) in size are landfilled from nearly 200 automobile shredders.

Smaller-sized pieces of non-ferrous metals from automobile shredders are not separated because their recovery is not cost-effective. They can only be consolidated and shipped to larger facilities for further processing. Mixed non-ferrous metals from industrial processes are often disposed or junked because hand-sorting and small-particle recovery technologies either do not work well or are not cost-effective. Nearly 2 billion pounds of valuable non-ferrous metals are discarded in landfills every year in the U.S. alone. Worldwide, the amount of metal wasted is far greater. If this metal could be economically recycled at high volumes, the potential value generated is estimated to be in excess of 1 billion dollars (U.S.) per year. Further, there are approximately 200 waste-to-energy facilities, 200 automobile shredders, and to thousands of metal scrap yards in the U.S. alone that could benefit financially (and otherwise) from an improved sorting system.

OES, mentioned above, is a known technique for sorting scrap metal, for example, as described in U.S. Pat. No. 6,545,240 B2, titled "Metal Scrap Sorting System" by Kumar, the entire contents of which are hereby incorporated by reference. A known problem with OES systems is that OES is not efficient at identifying a wide-range of metals and, therefore, typically is calibrated for use on a particular alloy group. For example, an OES system may be used to identify aluminum alloys only or magnesium alloys only. Applicant's understanding of the source of this problem is as follows. In order to achieve accurate identification for different base metals of alloys, known OES systems require that the calibration settings for OES spectral identification be adjusted for each group. For example, the calibration setting for an aluminum alloy is different than the calibration settings for a nickel alloy. As used herein, a "base metal" of an alloy is the metal having the largest percentage of the mass of the constituent elements of the alloy.

In contrast, XRF spectroscopy is well-suited for classifying a wide-range of metals, including the base metals of alloys. XRF spectroscopy has long been a useful analytical tool in the laboratory for classifying materials by identifying elements within the material, both in academic environments and in industry. The use of characteristic x-rays such as, for example, K-shell or L-shell x-rays, fluoresced from elements in response to being stimulated by x-rays, provides a method for positive identification of elements and their relative amounts present in different materials, such as metals and metal alloys. For example, radiation striking matter causes the emission of characteristic K-shell x-rays when a K-shell electron is knocked out of the K-shell by incoming radiation and is then replaced by an outer shell electron. The outer electron, in dropping to the K-shell energy state, emits x-ray radiation characteristic of the atom.

The energy of emitted x-rays depends on the atomic number of the fluorescing elements. Energy-resolving detectors can detect the different energy levels at which x-rays are fluoresced, and generate an x-ray signal from the detected x-rays. This x-ray signal then may be used to build an energy spectrum of the detected x-rays, and from the information, the element or elements which produced the x-rays may be identified. X-rays are fluoresced from an irradiated element and the detected radiation depends on the solid angle subtended by the detector and any absorption of this radiation prior to the radiation reaching the detector. The to lower the energy of an x-ray, the shorter the distance it travels before being absorbed by air. Thus, when detecting x-rays, the amount of x-rays detected is a function of the intensity of x-rays emitted, the energy level of the emitted x-rays, the emitted x-rays absorbed in the transmission medium, the angles between the fluoresced x-rays and the detector, and the distance between the detector and the irradiated material.

Although x-ray spectroscopy is a useful analytical tool for classifying materials, with current technology, the cost is high per analysis, and the time required is typically several seconds to minutes or hours. For example, some hand-held x-ray analyzers are able to acquire an XRF spectrum from a piece of scrap metal in approximately five to fifteen seconds, after which the user sorts the piece of scrap metal by hand. There are bench-top XRF systems that are capable of acquisition times within this range as well. Because of these relatively long analysis times, scrap yard identification of metals and alloys is primarily accomplished today by trained sorters who visually examine each metal object one at a time. Contamination is removed by shearing. A trained sorter observes subtle characteristics of color, hue, texture, and density to qualitatively assess the composition of the metal. Sometimes, spark testing or chemical "litmus" testing aids in identification. The process is slow and inaccurate, but is the most common method in existence today for sorting scrap metal to upgrade its value.

There have been disclosed a variety of systems and techniques for classifying materials based on the XRF of the material. Some of these systems involve hand-held or bench-top XRF detectors. These types of systems are less accurate than laboratory analyzers, but often give an accurate classification of the alloy in several seconds. Other systems include serially conveying pieces of material along a conveyor belt and irradiating each piece, in turn, with x-rays. These x-rays cause each piece of material to fluoresce x-rays at various energy levels, depending on the elements contained in the piece. The fluoresced x-rays are detected, and the piece of material is then classified based on the fluoresced x-rays, and is automatically sorted in accordance with this classification.

Such disclosed systems, however, have not been widely accepted commercially because they require more than one second to detect the x-rays and accurately classify the piece of material accordingly, and they are expensive relative to the number of objects identified per unit time.

An improved approach to sorting scrap metal and other materials is disclosed in U.S. Pat. No. 6,266,390, titled "High Speed Materials Sorting System Using XRF" by Sommer, Jr. et al. (hereinafter, "the Sommer patent"), the entire contents of which are hereby incorporated by reference. In the Sommer patent, XRF sensing is applied to classify pieces of material as small as ¼ inches, which are conveyed in a singulated stream through a sensing region at speeds as fast as 60 in/sec. to 120 in/sec. The Sommer patent discloses a novel system that employs fast-sorting techniques, algorithms and equipment to irradiate the pieces causing them to fluoresce x-rays, detect the x-rays, classify the piece based on the detected x-rays and sort the pieces off of the fast-moving conveyor belt at speeds as fast as 10 pieces per second or more.

A problem with known sorting systems, whether hand-held, bench-top, or a system involving conveyor belts, is the difficulty of using XRF spectroscopy to accurately classify pieces of material containing elements with low atomic number (i.e., low-Z elements). As used herein, a "low-Z element" is an element in the periodic table of elements having an atomic number of less than 22, i.e., less than the atomic number of titanium. As used herein, a "high-Z element" is an element in the periodic table of elements (including elements added after the filing date of this application) having an atomic number of 22 or greater, i.e., the atomic number of titanium or greater. For example, detection of pieces containing aluminum, which has an atomic number of 13, and other low-Z elements such as silicon and magnesium, is difficult with XRF spectroscopy. The problem is two-fold. First, the x-rays (even the x-rays of highest energy—K-alpha x-rays) fluoresced from the low-Z elements are at very low energy (e.g., approximately between 1-2 keV) such that they are easily absorbed in air. Second, for a given amount of x-rays (i.e., the x-rays from an x-ray source) irradiating a piece, low-Z elements within the piece fluoresce less x-rays than high-Z elements within the piece. The low-Z elements fluoresce less x-rays because the low-Z elements have a sparser concentration of electrons than the high-Z elements. Thus, for a given amount of impacting x-rays, there is a lower probability of dislodging electrons shells (i.e., energy levels) of low-Z elements than from shells of high-Z elements.

FIG. 1 is a graph 100 illustrating values of the x-ray energy for various common metals encountered in recycling. The energies for three different types of x-rays, Kα, Lα, and Lβ, are shown in FIG. 3 (shown as Ka, La and Lb, respectively). K x-rays are x-rays resulting from an electron of a K-shell of an atom (the inner most shell) being expelled or knocked out of the k-shell and being replaced by an electron from an outer shell (e.g., L-Q). A Kα x-ray is an x-ray resulting from when the replacing electron is from the next closest outer shell, L, whereas a Kβ x-ray (not shown) is an x-ray resulting from when the replacing electron is from the M-shell. L x-rays are x-rays resulting from an electron of an L-shell of an atom (the next inner most shell) being expelled or knocked out of the L-shell and being replaced by an electron from an outer shell (e.g., M-Q). An Lα x-ray is an x-ray resulting from when the replacing electron is from the next closest outer shell, M, whereas a Kβ x-ray is an x-ray resulting from when the replacing electron is from the N-shell. K x-rays have a higher energy than L x-rays.

From FIG. 1, it can be seen that the energy and yield of fluoresced x-rays is small for aluminum and magnesium compared to the other metals. FIG. 1 also illustrates the percentage of x-rays, for different energy levels, transmitted through air over various distances without first being absorbed by air (these calculations were determined by approximating the density of air to being equal to that of nitrogen). Curve 102 represents the percentage of x-rays transmitted a distance of 12.7 mm Curve 104 represents the percentage of x-rays transmitted a distance of 25.4 mm, and curve 106 represents the percentage of x-rays transmitted a distance of 38.1 mm. As is illustrated by curves 102, 104, 106, the percentage of x-rays transmitted without being absorbed by air increases as the energy of the x-rays increases and as the distance decreases.

One solution to the above problem, at least for sorting pieces of material containing only low-Z elements, is sorting pieces of material by "difference", i.e., by configuring a sorting system such that pieces of material containing only low-Z elements are the only pieces that are left on the conveyor belt after all other pieces have been classified and sorted. For example, the pieces containing only low-Z elements are sorted into a default bin. An example of this technique is described in the Sommer patent. This solution has some drawbacks. One drawback is that multiple low-Z elements cannot be sorted separately using this technique, as all pieces of material containing only low-Z elements are left on the conveyor belt.

Another drawback to this technique is that pieces of material containing both low-Z elements and high-Z elements may be incorrectly classified and sorted because at high speeds x-rays fluoresced by the high-Z elements may be the only fluoresced x-rays that are detected. Consider the case of aluminum. Aluminum alloys may have zinc and/or copper as an alloying agent, and some bronze alloys may have copper as the primary metal with aluminum as an alloying agent. Because an XRF sensor may be unable to detect x-rays fluoresced by aluminum when an aluminum alloy is exposed to x-rays for only a short time (e.g., in a high speed sorting system), these alloys may be mistakenly identified as zinc, copper, or brass (a copper alloy) and, consequently, may be mis-sorted, thereby contaminating the sorted zinc and to copper pieces with pieces of aluminum alloy containing zinc and copper.

A hand-held LIBS analyzer for identifying pieces of scrap metal that contain one or more low-Z elements such as aluminum, magnesium and silicon has been disclosed. However, such an analyzer would be slow and cumbersome, requiring the operator to touch a piece of scrap metal, hold the analyzer in position for several seconds, read the output of the analyzer, and then manually sort the piece of material by moving it into a sorting bin or other suitable location. Further, such a hand-held analyzer would be useful only for identifying that pieces of materials contain low-Z elements, but not for classifying a broad range of materials, which may contain high-Z and low-Z elements in any of a variety of combinations.

SUMMARY

In an embodiment of the invention, a piece of material is classified. X-rays fluoresced from the piece and optical emissions emitted from the piece are detected. The piece is classified based on at least one of: the detected x-rays, and the detected optical emissions.

In another embodiment of the invention, a computer program is used to control a computer to perform the method of the embodiment described in the preceding paragraphs.

In another embodiment of the invention, a system for classifying a piece of material is provided. The system includes a classification module to receive x-ray fluorescence information representing x-rays fluoresced from the piece, to receive optical emissions information representing optical emissions emitted from the piece, and to classify the piece based on at least one of the x-ray fluorescence information and the optical emissions information.

In yet another embodiment, a system for classifying a piece of material is provided. The system includes one or more inputs to receive x-ray fluorescence information representing x-rays fluoresced from the piece and optical emissions information representing optical emissions emitted from the piece. The system further includes means for classifying the piece based on at least one of the x-ray fluorescence information and the optical emissions information.

In yet another embodiment, a method of classifying a piece of material is provided. The method comprises acts of: (A) detecting x-rays fluoresced from the piece; (B) detecting optical emissions emitted from the piece; and (C) classifying the piece based on at least one of: the detected x-rays, and the detected optical emissions. In one embodiment, a predetermined number of potential classifications are available, and the act (C) includes acts of: (1) analyzing to only the detected optical emissions to reduce the predetermined number to a reduced number of potential classifications; and (2) classifying the piece of material as one of the reduced number of classifications based on the detected x-rays.

In yet another embodiment a method of classifying a piece of material is provided. The method comprises acts of: (A) detecting x-rays fluoresced from the piece; (B) detecting optical emissions emitted from the piece; and (C) classifying the piece based on at least one of: the detected x-rays, and the detected optical emissions. In one embodiment, a predetermined number of potential classifications are available, and the act (C) includes acts of: (1) analyzing only the detected x-rays to reduce the predetermined number to a reduced number of potential classifications; and (2) classifying the piece of material as one of the reduced number of classifications based on the detected optical emissions.

Other advantages, novel features, and objects of the invention, and aspects and embodiments thereof, will become apparent from the following detailed description of the invention, including aspects and embodiments thereof, when considered in conjunction with the accompanying drawings, which are schematic and which are not intended to be drawn to scale. In the figures, each identical or nearly identical component that is illustrated in various figures is represented by a single numeral. For purposes of clarity, not every component is labeled in every figure, nor is every component of each embodiment or aspect of the invention shown where illustration is not necessary to allow those of ordinary skill in the art to understand the invention.

DETAILED DESCRIPTION

Figure 1:
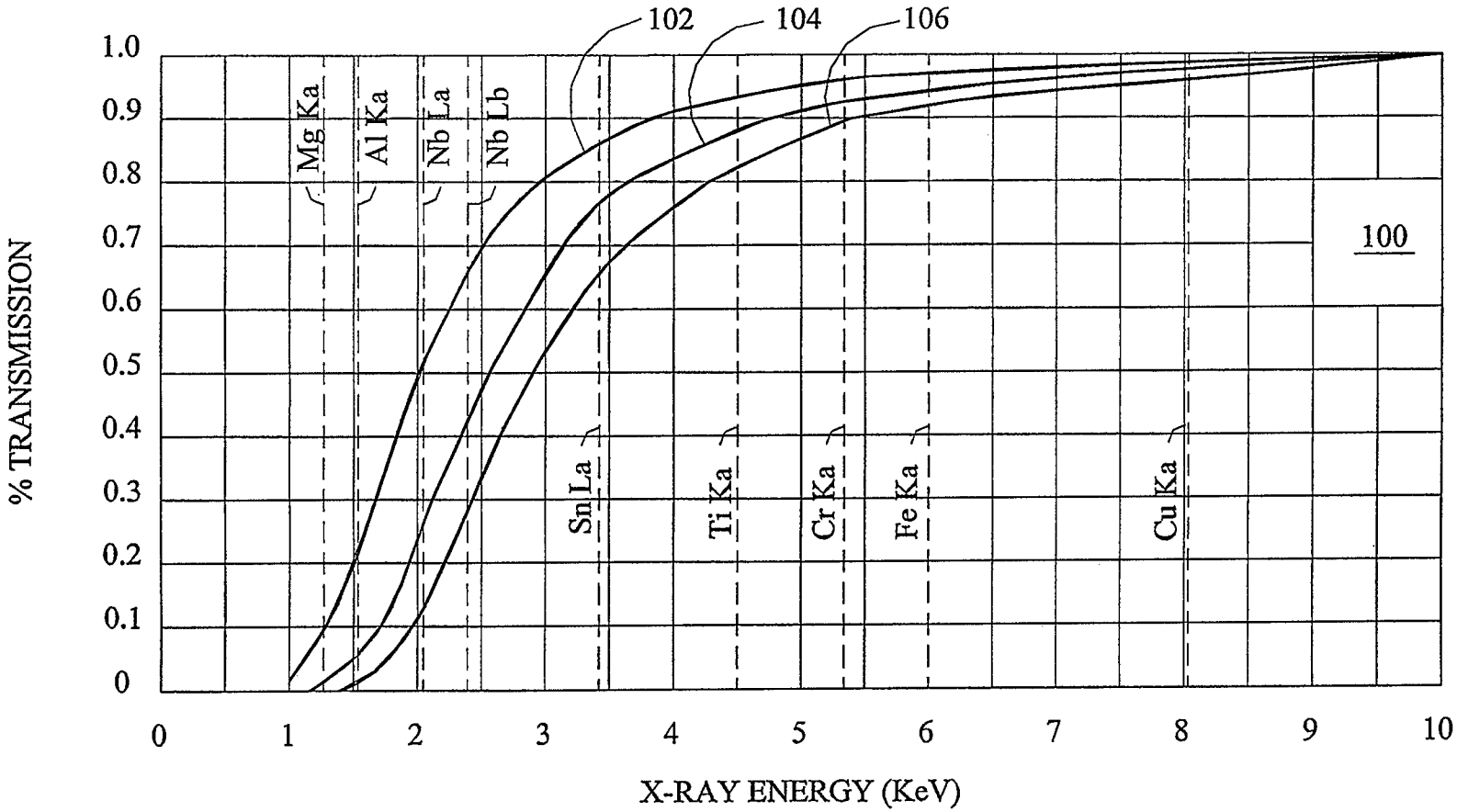
FIG. 1 is a graph illustrating values of x-ray energy for various common metals encountered in recycling, and illustrating the percent of x-rays of various energy levels that are transmitted for various distances without being absorbed by air.

Described herein are systems and methods for classifying a piece of material that includes one or more low-Z elements based on emissions (e.g., photonic emissions) detected from the piece of material. As used herein, classifying a piece of material that contains one or more low-Z elements includes identifying one or more low-Z elements within the piece of material. It should be appreciated that, although the systems and method described herein are described primarily in relation to classifying pieces of materials including low-Z elements, the invention is not so limited. The systems and methods described herein may be applied to classifying a piece of material that does not include any low-Z elements.

In one or more embodiments, both XRF spectroscopy and OES techniques, for example, Laser-Induced Breakdown Spectroscopy (LIBS), arc discharge spectroscopy (ADS) or spark discharge spectroscopy (SDS) may be used to classify the piece of material. In other embodiments, only XRF spectroscopy techniques may be used.

As used herein, to "classify" a piece of material is to determine (i.e., identify) a class of materials to which the piece of material belongs. The classes (i.e., classification) of materials are user-definable and not limited to any known classification of materials. The classes may be defined by using appropriate reference spectra and by programming the threshold values for these spectra, for example, as is described in the Sommer patent and/or as is described below in relation to the classification module 930 of FIG. 9 and Act 1010 of FIG. 10. The granularity of the classes may range from very coarse to very fine. For example, the classes may include: plastics, ceramics, glasses, metals and other materials, where the granularity of such classes is relatively coarse; different metals and metal alloys such as, for example, zinc, copper, brass, chromeplate, and aluminum, where the granularity of such classes is finer; or between specific grades of steel (or another alloy group), where the granularity of such classes is relatively fine. Thus, the classes may be configured (e.g., within classification module 930) to distinguish between materials of significantly different compositions such as, for example, plastics and metal alloys, or to distinguish between materials of almost identical composition such as, for example, different grades of an alloy.

It should be appreciated that the methods and systems discussed herein may be applied to accurately classify pieces of material for which the composition is completely unknown before being classified.

In one or more embodiments, a stream of pieces of material is moved along a conveying system (e.g., one or more conveyor belts or other means for conveying) into a stimulation and detection area. The stream of materials may include a single singulated stream, a plurality of singulated streams in parallel or a stream of pieces of material randomly distributed on the one or more conveyor belts. Each piece of material, in turn, is stimulated with first and second stimuli, of a same or different type. This stimulation causes the piece of to material to emit emissions, for example, photons. Such photons may include at least one of x-rays (i.e., x-ray photons) and optical emissions (i.e., optical photons). These emissions then are detected by one or more detectors of one or more types. The piece of material is then classified using, for example, a combination of appropriately configured hardware, software and/or firmware, based on the detected emissions. The amount of time that elapses from the first detection of the emissions until the piece of material is classified may be less than one second. Indeed, it may be shorter than that: less than five hundred milliseconds, or even less than one hundred milliseconds, such as less than fifty milliseconds. Ideally, it may be as low as ten milliseconds or less.

Downstream from the stimulation and detection area, the piece may be sorted (e.g., automatically) by removing it from the conveying system at an appropriate location, for example, using an air jet that ejects the piece of material into an appropriate sorting bin. As used herein, to "sort" a piece of material means to cause the piece to be physically grouped with other pieces of material. These other pieces of material may include pieces classified in a same or different class than the sorted piece depending on the desired sort, as is described in more detail below. The piece of material may be in continual motion (e.g., moving along the conveying system) while the acts of stimulating, detecting, classifying and sorting operations are performed or, alternatively, the piece may be stationary at some point during the process, for example, while the piece is being stimulated and emissions therefrom are being detected.

In one or more embodiments, the raw materials for one or more alloys may be collected by sorting pieces of material in a suitable manner, for example, as is described below in relation to FIG. 9.

In one or more embodiments, the acts of conveying, stimulating, detecting, classifying and sorting all may be performed automatically, i.e., without human intervention. For example, a conveying system, one or more sources of stimuli, one or more emissions detectors, a classification module, a sorting apparatus and other system components may be preconfigured to perform these and other operations automatically.

In one or more embodiments, each piece of material may be stimulated by x-rays that cause the piece to fluoresce x-rays, and may be stimulated by another stimulus, for example, a laser beam or electrical discharge, that causes the piece to emit optical emissions. The resulting x-rays and optical emissions then may be detected, and the piece of material classified based on the detected x-rays and optical emissions. The detected optical emissions may be useful in identifying low-Z elements within the piece of material, so that the piece of to material can be accurately classified even if it contains low-Z elements.

In one or more embodiments, each piece of material may be stimulated by first x-rays of a first energy range and second x-rays of a second energy range (e.g., a lower range than the first energy range), causing the piece to fluoresce x-rays. In one or more aspects of this embodiment, the second x-rays may have a higher intensity (i.e., more x-ray energy may be transmitted per unit time), possibly ten times, a hundred times, a thousand times or even ten thousand times (or greater) more intense than the intensity of the first x-rays. If the second x-rays have a higher intensity, then a larger percentage of the x-rays stimulating the piece are within the second energy range than if the intensities of the first and second x-rays were the same. Consequently, a larger percentage of the x-rays fluoresced from the piece of material are within the second energy range (e.g., lower energy range) than otherwise would be if the intensities were the same. As a result, a larger number of the detected x-rays are within the second energy range than would be otherwise. Thus, if the second energy range is an energy range within which low-Z elements fluoresce, and the second x-rays are of higher intensity than the first x-rays, then a greater number of the x-rays fluoresced from these low-Z elements are detected, so that pieces of material containing low-Z elements can be classified more accurately.

In one or more embodiments, the conveying system includes two conveyor belts, with an air gap in-between, over which pieces of material are conveyed from one belt to the other. These one or more belts may be configured to convey pieces of material at any of a variety of speeds, which in one or more embodiments may be as fast as eight feet per second or faster. These one or more belts may be arranged in series, with a first belt having a higher surface area than the second belt, such that pieces of material may fall from the first belt onto the second belt. Alternatively, the two belts may have a same surface height. In one or more embodiments, the conveying system may include a single conveyor belt that is transparent to the types of stimuli being used to stimulate the pieces of material and/or to the types of emissions resulting from such stimulation (e.g., XRF or optical emissions). Alternatively, in a single belt embodiment, the single belt may include a substantial open area through which stimuli and/or emissions may pass. For example, the conveyor belt may be a mesh belt or another type of belt that includes openings. Further, in such a single belt embodiment, the single belt may include windows through which stimuli and/or emissions may pass. Advantageously, such windows may define the lower surface of the pieces of material as they are stimulated.

Each piece of material may be stimulated while passing over one or more sources of stimuli positioned beneath any of an air gap, opening or window described above. Such openings, air gaps and windows enable one or more emissions detectors and/or one or more sources of stimuli to be placed in close proximity to the location at which each piece is stimulated. For example, if a stimulus (e.g., x-rays) causes the piece to fluoresce x-rays, an XRF detector can be placed in close proximity to the location at which the piece is stimulated, regardless of the size or shape of the piece. Accordingly, the XRF detector detects more x-rays fluoresced by low-Z elements before such x-rays are absorbed by air than would be detected if the XRF detector is positioned further away. Further, a laser can be placed at a location beneath the air gap that is a relatively constant distance from the location at which each piece of material passes. As a result, the laser does not have to be re-focused for each piece of material that passes over the air gap. It should be appreciated that the air gap, opening, or window, depending upon the embodiment, defines a vertical position of the lower surface of the pieces of materials being stimulated. In the case of a two-belt embodiment, the surface heights and the belt speeds of the two belts may be configured such that when a piece of material is thrown or conveyed across the air gap, it undergoes little change in its vertical position (i.e., in the Z direction).

Another benefit of providing an air gap, window or open area is that the one or more sources of stimuli can be positioned to prevent stimulation of objects in the stimulation area other than the piece of material. For example, if one of the stimulus sources is an x-ray source, the x-ray source (e.g., an x-ray tube) may be positioned close enough to the bottom surfaces of pieces being irradiated to prevent components of the conveying system and system components within the stimulation area from fluorescing x-rays that may be detected by an x-ray detector.

In one or more embodiments, an x-ray absorption detector array, or another suitable device, may be provided to determine the position of a piece of material within a stimulation and detection area. The x-ray absorption detector array may be positioned such that each piece of material is conveyed between the x-ray detector and the one or more x-ray sources. The x-ray absorption detector array can detect when a piece of material passes between the one or more x-ray sources and itself, based on the amount of x-rays that it detects, thus providing positional information regarding the piece of material being stimulated. This positional information can be used for any of a variety of purposes, for example, to position one or more other emissions detectors, to position one or more stimulus sources, to assist in controlling a sorting apparatus, and for other reasons.

In one or more embodiments, curve fitting techniques may be used in classifying a piece of material. Using curve fitting techniques, immature emissions spectra, built from emissions detected over a relatively short period of time (as short as ten milliseconds or less) can be used to accurately sort the piece of material. This short detection time enables the amount of time that elapses from the first detection of the emissions until the piece of material is classified to be less than one second. Indeed, it may be shorter than that: less than five hundred milliseconds, or even less than one hundred milliseconds, such as less than fifty milliseconds. Ideally, it may be as low as ten milliseconds or less.

Curve fitting techniques may be used to classify the piece of material as follows. From the detected emissions, which may include x-rays and/or optical emissions, one or more emissions spectra may be determined. These emissions spectra may include an XRF spectrum and/or an optical spectrum. The emissions from which the emission spectrum are created may be detected over a relative brief period of time, as short as ten milliseconds or less. Consequently, the resulting emissions spectra may be immature. In other words, the visual pattern of the histogram of the emission spectra is more jagged than if the detection times for the spectra were longer, which would produce a smoother, more mature histogram. From each of the one or more spectra, predetermined regions of interest (ROI) may be analyzed. The predetermined ROI may include one or more ranges of energy levels in an XRF spectrum and/or one or more ranges of wavelengths in an optical spectrum. These ROI may be pre-selected to correspond to energy levels or wavelengths at which certain elements fluoresce x-rays or emit optical photons, respectively. For each predetermined ROI, a peak value for the ROI may be estimated by applying a shaping function to the sub-spectra, for example, to the number of counts detected within the ROI. Thus, by applying a shaping function to each ROI, a peak value for a more mature spectrum within the ROI is estimated using the less mature spectrum actually detected for the ROI. The shaping function may be any of a variety of known shaping functions, for example, a Gaussian distribution function or a Poisson distribution function. The peak values estimated for the predetermined ROI may be used to classify the piece of material using any of a variety of techniques, described in more detail below in relation to FIGS. 9-11. Classifying the piece of material may include comparing the determined peak value of the piece of material to the peak values of ROI for one or more reference materials, as is described in more detail below.

It should be appreciated that, although the systems and methods described herein are to described primarily in relation to classifying pieces of material in solid state, the invention is not so limited. The systems and methods described herein may be applied to classifying a material having any of a range of physical states, including, but not limited to a liquid, molten, gaseous or powdered solid state, another state, and any suitable combination thereof.

The systems and methods described herein may be applied to classify and/or sort individual pieces having any of a variety of sizes as small as a ¼ inch in diameter or less. Even though the systems and methods described herein are described primarily in relation to sorting individual pieces of material of a singulated stream one at a time, the systems and methods described herein are not limited thereto. Such systems and methods may be used to stimulate and detect emissions from a plurality of materials concurrently. For example, as opposed to a singulated stream of materials being conveyed along one or more conveyor belts in series, multiple singulated streams may be conveyed in parallel. Each stream may be a on a same belt or on different belts arranged in parallel. Further, pieces may be randomly distributed on (e.g., across and along) one or more conveyor belts. For example, the pieces of material may include flakes, grindings, filings, chips and turnings ("small pieces") made of metal and/or one or more other materials. Such small pieces are commonly found among scrap metals. Accordingly, the systems and methods described herein may be used to stimulate, and detect emissions from, a plurality of these small pieces at the same time. In other words, a plurality of small pieces may be treated as a single piece as opposed to each small piece being considered individually. Accordingly, the plurality of small pieces of material may be classified and sorted (e.g., ejected from the belt) together. It should be appreciated that a plurality of larger pieces of material also may be treated as a single piece of material.

Although the systems and methods described herein are described primarily in relation to sorting pieces of material, such systems and methods are not limited to that use. They may be used for other applications, for example, identifying elements (e.g., contaminants) within a piece of material (e.g., a molten mass of material) or determining the composition of a piece of material.

The methods and systems disclosed herein may be applied to a handheld system for classifying pieces of material. In such a system, adjustments would have to be made for portability, but the general methods described herein for stimulating, detecting, building emission spectra and classifying pieces of material based on those spectra may be used.

The function and advantage of these and other embodiments of the present invention will be more fully understood from the examples discussed below. The following examples to are intended to facilitate an understanding of the invention and illustrate the benefits of the present invention, but do not exemplify the full scope of the invention.

EXAMPLES

Figure 2:
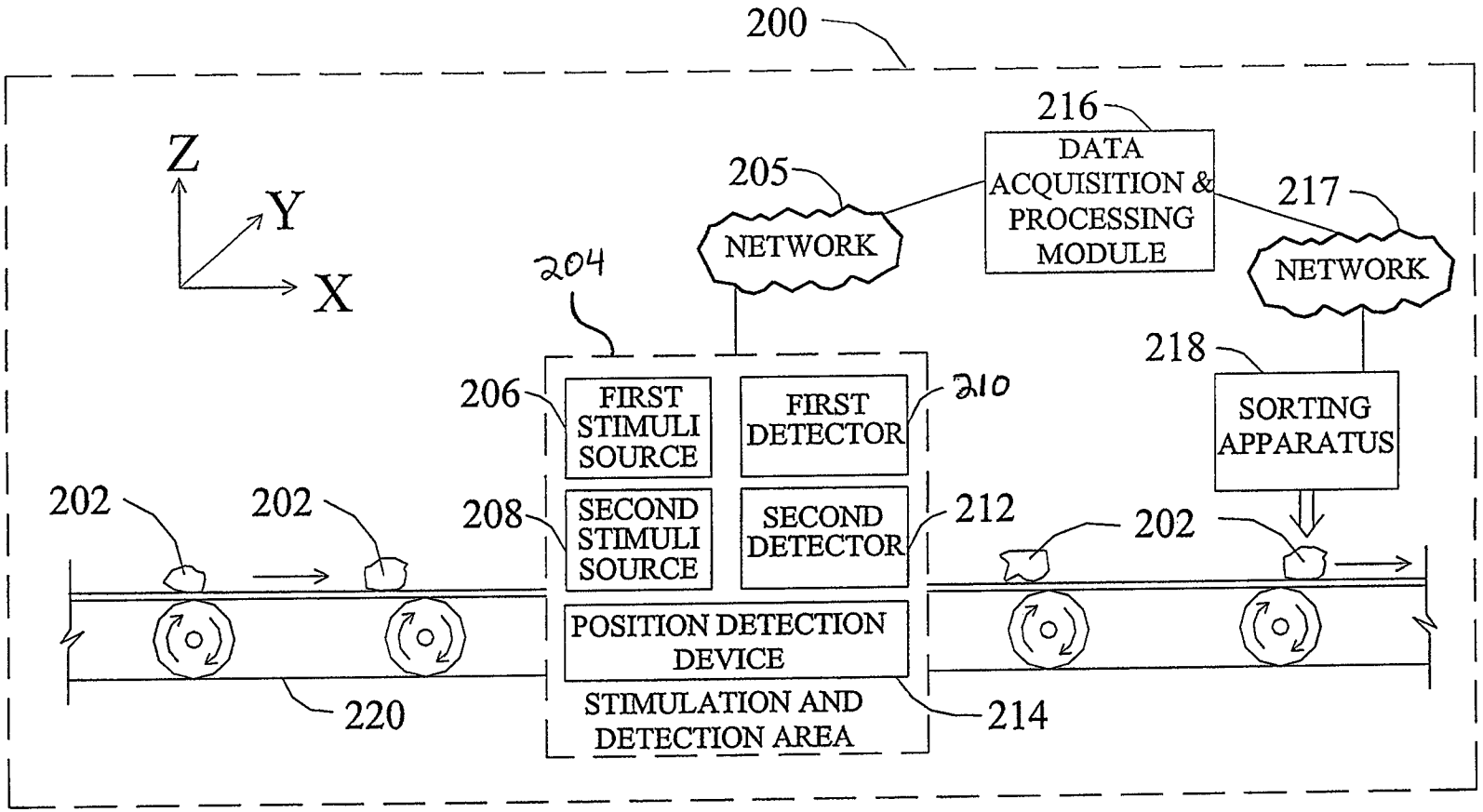
FIG. 2 is a block diagram illustrating an example of a system for sorting pieces of material using multiple sources of stimulation, according to one or more embodiments of the invention.

FIG. 2 is a block diagram illustrating (very schematically) an example of a material sorting system 200 according to one or more embodiments of the invention. System 200 is merely an illustrative embodiment of a system for sorting pieces of material using multiple sources of stimulation. Such an illustrative embodiment is not intended to limit the scope of the invention, as any of numerous other implementations of a system for sorting pieces of material using multiple sources of stimulation, for example, variations of system 200, are possible and are intended to fall within the scope of the invention.

A conveying system 220 conveys a singulated stream of pieces of material 202 into a stimulation and detection area 204, which may be an enclosed area, for example, a chamber. Although a singulated stream of pieces is illustrated in FIG. 2, it should be appreciated that in other embodiments, the pieces of materials may be conveyed in parallel singulated streams or randomly-distributed streams. The pieces of material may have been received by the conveying system 220 from any of a variety of sources, for example, a suitable feeder (not shown). The stimulation and detection area 204 may include any of first stimulus source 206, second stimulus source 208, first emissions detector 210, second emissions detector 212 and position detector 214.

The first and second stimulus sources 206 and 208 each may be any of a variety of types of stimulus sources, for example, a laser, an electrical discharge device, an x-ray source (e.g., an x-ray tube or an isotope), another type of stimulus source, or any suitable combination thereof. In one or more embodiments, the stimulus sources 206 and 208 may be a same type of stimulus source. In other embodiments, the stimulus sources may be of different type, as will be described in more detail below. Each piece of material 202 that enters the stimulation and detection area may be stimulated by the first stimulus source 206 and the second stimulus source 208 (e.g., concurrently), producing first emissions and second emissions, respectively, from the piece of material. Depending on the types of the first and second stimulus sources, the first and second emissions may be of any of a variety of types, for example, x-rays, optical emissions, or any suitable combination thereof.

Each of the first and second emissions detectors 210 and 212 may be any of a variety of types of detectors, for example, a fluoresced x-ray photon detector (i.e., an x-ray detector or XRF detector), an optical emissions collector, a color sensor, a shape sensor, a surface texture sensor, or any suitable combination thereof. The types of the first and second emissions detectors 210 and 212, and whether a second emissions detector 212 is necessary, may depend on the types of emissions from the pieces of material. In one or more embodiments, if the emissions from the pieces of material (as a result of being stimulated by the first and second sources 206 and 208) are a same type of emission, then only one emissions detector of a first type may be used. More than one emissions detector of the first type may be used if desired. For example, as will be described below in more detail in relation to FIG. 3, in one or more embodiments of the invention, the first and second stimulus sources 206 and 208 are both x-ray sources that cause pieces of material to fluoresce x-rays. In such embodiments, one or more x-ray detectors are the only type of emissions detectors used to detect the x-rays, as other types are not needed.

Position detection device 214 may be any of a variety of types of position detection device, for example, a x-ray absorption detector array, an image sensor, other types of detectors, or any suitable combination thereof. In one or more embodiments of the invention, the position detection device 214 may be used to determine a position of the piece within the stimulation and detection area 204. For example, the position detection device may be operable to determine the position of the piece of material in an x-y plane with respect to the conveying system 220, where, as shown in FIG. 2, x represents the direction in which the piece is being conveyed and y represents the direction perpendicular to the direction of movement and parallel to a top surface of the conveying system. As will be described in more detail below, this positional information may be used to aim one or more stimulus sources and/or one or more emission detectors, to produce and detect, respectively, emissions. Further, this positioning information could be used, for example, by data acquisition and processing module 216 and/or sorting apparatus 218 to sort pieces of material.

Each piece of material 202 may be received in the stimulation and detection area 204, and may be stimulated by stimuli from the first and second stimulus sources 206 and 208. These stimuli cause the pieces of material to emit emissions that are detected by the first detector 210 and, if necessary or desired, by other detectors such as a second detector 212.

One or more elements 206, 208, 210, 212 and/or 214 of stimulation and detection area 204 may be connected to data acquisition and processing module 216 by network 205. As used herein, a "network" is a group of two or more components interconnected by one or more segments of transmission media on which communications may be exchanged between the components. Each segment may be any of a plurality of types of transmission media, including one or more electrical or optical wires or cables made of metal and/or optical fiber, air (e.g., using wireless transmission over carrier waves) or any combination of these transmission media. As used herein, "plurality" means two or more. It should be appreciated that a network may be as simple as two components connected by a single wire, bus, wireless connection or other type of segment. Further, it should be appreciated that when a network is illustrated in a drawing of this application as being connected to an element in the drawing, the connected element itself is considered part of the network. Thus, the network 205 may be as simple as one or more wires, data buses or wireless connections between the data acquisition and processing module 216 and one or more components residing within the stimulation and detection area 204.

The data acquisition and processing module 216 may receive positioning information and emission information, and may issue positioning instructions to one or more of the stimulus sources and/or emissions detectors. Further, the data acquisition and processing module 216 may issue one or more sorting instructions across network 217 to sorting apparatus 218. Network 217 may be as simple as a single network segment connecting data acquisition and processing module 216 and sorting apparatus 218. It should be appreciated that networks 205 and 217 may be combined into a single network.

The sorting apparatus may be any of a variety of types of sorting apparatus, for example, an air jet apparatus that includes one or more air jets disposed along the path of conveying system 220. In response to receiving a sorting instruction, the sorting apparatus 218 may be configured to activate one or more of the air jets such that the one or more air jets emit a stream(s) of air that cause(s) a piece of material to be ejected from the conveying system 222, for example, into a sorting bin. Any of a variety of types of air jets may be used, such as high-speed air valves from Mac Industries. These valves supply the jets with air pressure at, for example, 60-90 psi, with operating/closing times as low as 15 ms or less. Other types of sorting apparatuses and techniques may be used, such as robotically removing the pieces of materials from the conveying system 222, pushing the piece of material from the conveying system, or causing an opening in the belt from which a piece of material may drop.

System 200 also may include a sorting bin that receives pieces of material not ejected from the conveying system 220. For example, such a sorting bin may be located at the end of conveying system 220. The data acquisition and processing module may not instruct the sorting apparatus to eject a piece of material such that it falls into such bin. Thus, a sorting bin may serve as a default sorting bin into which unclassified pieces of material are dumped. Alternatively, such a sorting bin may be used to receive one or more classifications of pieces of material by deliberately not assigning any of the other sorting bins that corresponds to an air jet (or other ejecting means) to the one or more classifications.

Depending upon the classifications of materials desired, multiple classifications may be mapped to a single air jet (or other ejection means) and sorting bin. In other words, there need not be a one-to-one correlation between classifications and sorting bins. For example, it may be commercially beneficial to sort copper and brass into the same sorting bin. To accomplish this sort, when a piece of material is classified as either copper or brass, the same air jet may be activated to sort the copper or brass piece into the same sorting bin. The contents of this sorting bin may, for example, then be used to create a copper/brass alloy. This sorting technique may be applied to produce any desired combination of material pieces and element distribution. The mapping of classifications may be programmed into the classification module 930 described below in relation to FIG. 9, to produce such desired combinations. Thus, classifications may be mapped to sorting bins so as to create the raw materials from which an alloy or other combinations of materials may be created. Creating alloys in this fashion is described below in more detail in relation to classification module 930 of FIG. 9.

The conveying system 220 may have any of a variety of geometries, materials of construction, and operating parameters, each of which may be optimized, for example, depending upon types of materials being sorted. The properties of materials to be sorted that may influence the geometry, materials of construction and operating parameters of the conveying system 220 include: size, density, geometry, frictional properties and moisture content. The conveying system 220 may include one or more conveying belts made from any of a variety of manufacturers, for example, Dorner and QC Industries. These one or more conveyor belts may be customized by the manufacturer based on the desired geometry, materials of construction and operating parameters. Each of the one or more conveying belts may be made from any of a variety of materials, including but not limited to: rubbers, polymers, metals and cloths/fabrics. The one or more conveyor belts may be constructed and arranged to include ridges, pockets, side walls, mesh, cleats, joins and embedment, or any suitable combination thereof, and may be made in various thicknesses and sizes.

In one or more embodiments of the invention, the conveying system 220 may be divided into multiple belts in series. For example, two belts may be provided, where a first belt to conveys the pieces of material into the stimulation and detection area 204 and a second belt conveys the pieces of materials away from area 204. The second belt may be positioned at a lower height than the first belt such that the pieces of material 202 fall from the first belt onto the second belt in the stimulation and detection area 204. Further, the surface heights and the speeds of the belts may be configured such that the pieces do not move around on the second belt after landing on the second belt. In one or more embodiments, during conveyance through the stimulation and detection area, each piece of material may be slid across a window of material that allows x-rays and/or light to pass through. Accordingly, an x-ray source and/or optical stimulating device (e.g., laser) may be situated to irradiate x-rays and/or light, respectively, through the window.

The conveyor belt (or part of a conveyor belt) downstream from the stimulation and detection area 204 may be implemented as a circular conveyor or carousel, and the air jets or other suitable removal means may be arranged along the exterior or interior of the circular conveyor. Further, the entire conveying system 220 may be circular, where the pieces of material are fed onto the conveying system 220, and the stimulation and detection area is located at a point along the conveying system 220.

In one or more embodiments, gravity may be used to accelerate the speed of the pieces of materials. For example, the conveying system 220 may convey pieces of material onto a surface that slopes downward leading toward area 204. Further, at some point along the path of conveyance, the pieces of materials may be dropped into free fall, and be stimulated during free fall from a stimulus source or sources located along the sides. The emissions could also be detected during free fall from one or more detectors located along the path of trajectory. Such an arrangement reduces background radiation if an x-ray source is used; however, the detection process becomes more complex. The location and speed of each falling piece may need to be detected to properly time the sorting process (constant speed cannot be assumed as in other embodiments). Further, the inherent unstable nature of pieces rolling down a slope or in free fall introduces a variable element into the sorting process. The position detection device 214 can at least assist in determining the position and speed of pieces in such an embodiment.

The conveying system 220 may include one or more belts that may be depressed or troughed in the center such that the pieces of material gravitate to the center (in the y-direction) of the one or more conveyor belts, such that they are aligned to pass directly beneath or above one or more emissions detectors and/or source of stimulus. Other techniques may be used to center pieces of material on the belt. For example, a materials feeder may be configured to do so.

Optionally, the pieces of material fed onto the conveying system 220 may be flattened with a flattening apparatus (not shown), for example, a rolls crusher before being fed onto the conveying system 220. By flattening the piece of material, friable materials adhering to the piece of material may be liberated. Further, flattening a piece of material before feeding the piece onto the conveying system improves sorting and classification of the pieces of materials. For example, flattened pieces of material move less on the conveying system, and do not roll as much as non-flattened pieces. Consequently, the position of a piece of material can be anticipated by the data acquisition and processing module 216. Module 216 may be configured to control the sorting apparatus based on this anticipation so that the piece is properly sorted by sorting apparatus 218. Also, flattening the pieces of material provides a larger surface area to irradiate, and from which to detect x-rays. Consequently, the piece of material is bombarded with, and fluoresces, more x-rays, resulting in a more complete XRF spectrum being determined for the piece of material than otherwise would have been determined. Further, the composition of the piece of material is less influenced by surface contaminants because during flattening fresh material surfaces are exposed, such that a cleaner XRF spectrum is produced. Consequently, the spectrum detected is more representative of the piece of material and not other materials that may be adhering to the surface of the piece of material.

Another benefit to flattening pieces of material prior to stimulation is that flattening the piece of material provides a more regular (i.e., smoother) surface on the piece of material. Having a more regular surface allows the focusing of a laser or other optical stimulating device to be more predictable, thus making easier the focusing of the optical stimulating device for each piece.

Figure 3:
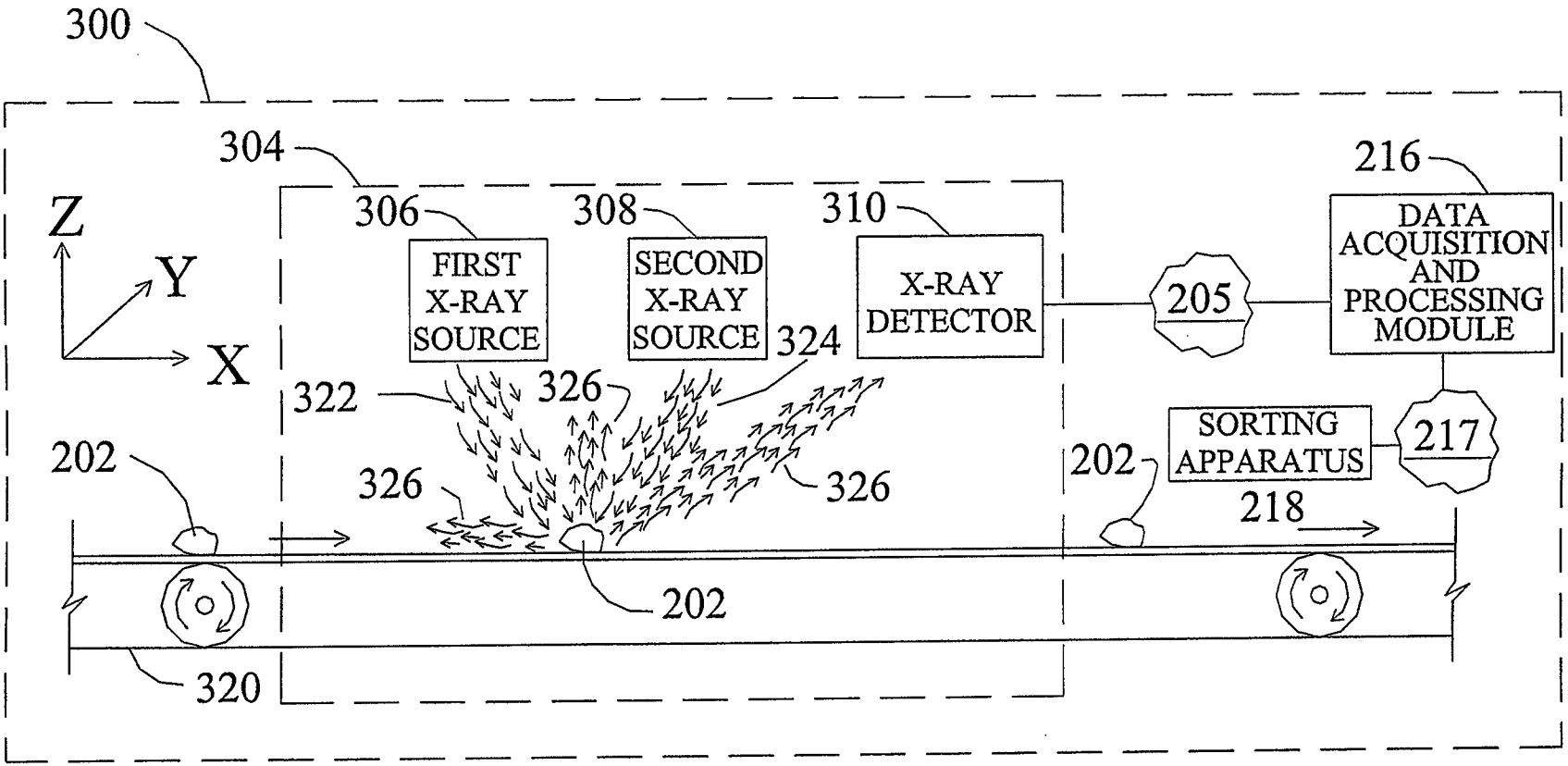
FIG. 3 is a block diagram illustrating an example of a system for sorting pieces of material using multiple x-ray sources, according to one or more embodiments of the invention.

FIG. 3 is a block diagram illustrating an example of a system 300 for sorting pieces of material using two x-ray sources 306 and 308. System 300 is merely an illustrative embodiment of a system for sorting pieces of material using multiple x-ray sources. Such an illustrative embodiment is not intended to limit the scope of the invention, as any of numerous other implementations of a system for sorting pieces of material using multiple x-ray sources, for example, variations of system 300, are possible and are intended to fall within the scope of the invention.

System 300 includes any of first x-ray source 306, second x-ray source 308 and x-ray detector 310, all within stimulation and detection area 304, which may be an enclosed area to such as an x-ray chamber. It should be appreciated that additional x-ray detectors and/or x-ray sources may be provided. If multiple x-ray detectors are provided, each detector may be optimized to detect x-rays having a particular characteristic, for example, x-rays having an energy level within a particular range. For example, one or more x-ray detectors may be an x-ray detector from Amptek (e.g., a Cadmium Telluride detector) configured to detect x-rays in relatively high energy levels (e.g., greater than 10 keV), and one more other x-ray detectors may be an x-ray detector from Rontec operable to detect x-rays in relatively low energy levels (e.g., less than 25 keV). In an embodiment, four x-ray detectors may be provided.

System 300 also includes any of networks 205 and 217, data acquisition and processing module 216, sorting apparatus 218 and conveying system 320. The conveying system 320 may include one or more conveyor belts that convey pieces of material 202 into the stimulation and detection area 300 (e.g., an x-ray chamber), where the pieces of material are bombarded with irradiating x-rays 322 and 324 to produce fluoresced x-rays 326.

The first x-ray source 306 may produce irradiating x-rays 322 and the second x-ray source 308 may produce irradiating x-rays 324. Each x-ray source may be any of a variety of types of x-ray sources. Each x-ray source may be configured to produce broadband x-rays or monochromatic x-rays. For example, monochromatic x-rays may be produced using an x-ray source that incorporates a doubly-curved crystal (DCC) and one or more filters. For example, one or more of the x-ray sources may include a DCC and filter available from X-ray Optical Systems, Inc. Such an x-ray source typically reduces the background radiation and scatter typically caused by a broadband x-ray source in an x-ray chamber or other enclosed area. Such a monochromatic x-ray source can be used to create x-rays of high intensity at a predetermined energy level.

The intensity of x-rays produced by each x-ray source is proportional to the rate (i.e., counts per unit time) at which x-rays are transmitted. The number of x-rays fluoresced from a piece of material irradiated with x-rays 322 and 324 is a function of the intensity and energy levels of the irradiating x-rays 322 and 324. Thus, when either of the x-ray sources 306, 308 produces less intense x-rays, less x-rays are fluoresced from the piece of material. Consequently, fluoresced x-rays 326 are detected from the piece of material for a longer period of time than otherwise would be necessary to produce an XRF spectrum with a strong enough image, i.e., a recognizable spectral pattern.

Each x-ray source may be an isotope-based x-ray source, for example, $Cd^{129}$, $Am^{241}$, $Co^{57}$ and $Fe^{55}$. Although isotope-based sources provide monochromatic x-rays, which is desirable in some circumstances, isotope-based sources do not produce x-rays at intensities that can be produced by an x-ray tube. Further, as described above, monochromatic x-rays can be produced from an x-ray tube or other type of broadband x-ray source by using a DCC or by other means.

Therefore, to increase the speed of detection and classification, each of the first and second x-ray sources 306 and 38 may be an x-ray tube, for example, a water-cooled Varien OEG-50 x-ray tube, which may be powered by a power supply such as a Spellman RMP 300 power supply. Such an x-ray tube and power supply combination is capable of operating at up to at least 300 watts at 30 kV. In an embodiment, at least one of the x-ray tubes may be operated at 13-17 kV at levels in the range of 1-10 watts. In other embodiments, at least one of the x-rays sources may be operated at 100 kV and at 17 mA. An x-ray tube is capable of producing x-rays several orders of magnitude more intense than any commercially available isotope-based x-ray source. This intensity is particularly advantageous when the piece of material 202 being stimulated and classified is relatively small, or when the one or more x-ray sources is a relatively long distance away from the piece of material 202, or when the piece of material 202 is a relatively long distance away from the x-ray detector 310. Further, an x-ray tube has the added advantage of being capable of being turned off when not in use, in contrast to a radioactive isotope.

Using an x-ray tube, or another comparable high-intensity irradiation source, as at least one of the first and second x-ray sources 306 and 308 causes massive amounts of x-rays to be present in the stimulation and detection area 304, orders of magnitude more than would be present if an isotope-based source were used. The presence of this amount of x-rays causes problems with the detection of x-rays by the x-ray detector 310 and the determination of an accurate XRF spectrum. To address these problems, the irradiation and detection of x-rays may be conditioned, for example, as described in the Sommer patent. Such conditioning may include any of: filtering and/or aiming (e.g., collimating) any x-rays output by x-ray sources, filtering any x-rays detected by x-ray detectors, aiming (e.g., collimating) the detection of x-rays by any x-ray detector, making or lining components of the conveying system (e.g., components of one or more conveyor belts) and/or detection area (particularly if enclosed) with materials that do not fluoresce x-rays within the energy range being considered in classifying pieces of material; other conditioning techniques; and any suitable combination thereof. For example, to prevent the x-ray detector 310 from being flooded, one or both of the to first x-ray and second x-ray sources 306 and 308 may be operated at low power levels to produce relatively low-intensity radiation such as, for example, at 13.5 V and 0.03 mA, given an x-ray power output of only 0.4 watts. It should be appreciated that these conditioning techniques also may be employed in embodiments of the invention that incorporate any of systems 200, 600, 700 and 800 described in relation to FIGS. 2, 6, 7 and 8, respectively.

In one or more embodiments, the first irradiating x-rays 322 produced by the first x-ray source 306 are within a first energy range, and the second irradiating x-rays 324 produced by the second x-ray source are within a second energy range 308. For example, the first x-ray source 306 may produce x-rays 322 spanning a relatively full energy range, and the second x-ray source 306 may produce second irradiating x-rays 324 limited to a narrower and lower energy range (e.g., an energy range within which low-Z elements fluoresce x-rays). By producing more x-rays within the lower energy range, the likelihood of detection of the low-Z elements, for example, aluminum, magnesium, silicon, etc., is increased. This increased likelihood of detection results for the following reasons. The more intense x-rays increase the likelihood that the irradiating x-rays from the x-ray source will reach the piece of material. Further, the higher intensity increases the likelihood that the sparsely-spaced elections of low-Z elements of the piece will be impacted and dislodged, as opposed to the irradiating x-rays passing through the low-Z elements without impact. This is analogous to spraying a fire hose as opposed to a garden hose at a collection of sparsely-spaced objects. The stream of water from the garden hose is far more likely to pass through the objects without hitting them than the stream of water from the fire hose. Thus, the fluoresced x-rays 326 include a higher number of x-rays fluoresced from low-Z elements than otherwise would be fluoresced. As a result, more x-rays fluoresced from low-Z elements reach x-ray detector 310 without being absorbed in air. For example, the first and second x-ray sources may be configured such that the first irradiated x-rays 322 range in energy from 0 keV to 30 keV or greater, and the second irradiated x-rays 324 have energies of 4.5 keV or lower. To produce x-rays of 4.5 keV or lower, the second x-ray source 308 may be an x-ray tube having a Ti target of $K\alpha$=4.5 keV. Optionally, the second x-ray source 308 may be operated at an extremely high output flux, thereby increasing the count of irradiated x-rays 324, for example, by orders of magnitude (e.g., by ten, one hundred, one thousand, ten thousand, or even more). If the piece 202 being irradiated contains low-Z elements, this increased amount of irradiated x-rays 324 having an energy of 4.5 keV or lower produces an increased number of fluoresced x-rays 326 from low-Z elements having an energy level 4.5 keV or less.

Thus, for pieces of material including a plurality of elements, including one or more low-Z elements such as Si, Mg and Al, a greater number of the fluoresced x-rays 326 are x-rays fluoresced from the low-Z elements. Accordingly, due to the higher number of low-Z x-rays, a greater number of low-Z x-rays reach the x-ray detector 310 instead of being absorbed by air. Therefore, the relative proportions of x-rays from low-Z and high-Z elements that reach the x-ray detector 310 more accurately reflect the relative proportions of low-Z and high-Z elements in the piece of material. Consequently, the XRF spectrum determined from the fluoresced x-rays 326 more accurately represents the proportion of low-Z elements present in the piece of material, so that the piece of material is more accurately classified.

The x-ray detector 310 may be any of a variety of types of x-ray detector, for example, an Si-PIN diode detector, an Si(Li) diode detector, a high-purity Ge diode detector, or other type of x-ray detector. The x-ray detector may be equipped with a window comprising one or more x-ray transparent materials (e.g., beryllium, another low-Z element or an organic material) such that the window admits low-energy x-rays. In an embodiment, the x-ray detector is an Amptech XR-100T with Si-PIN diode detector with beryllium window. The use of an Si-PIN diode detector increases the amount of fluoresced x-rays 326 that may be detected in a given time (i.e., increases the count rate) by up to three times the count rate or more of current commercially-available classification and sorting systems.

Si-PIN, Si(Li) and Ge diode detectors all are capable of handling high-intensity XRF without flooding, and have energy resolution of 0.25 keV or less. Si(Li) and high-purity Ge diode detectors are capable of detecting x-ray energies in a range from less than 1 keV to over 1,000 keV. Further, Si(Li) and high-purity Ge detectors provide high x-ray throughput, as such detectors are capable of counting rates in excess of 100,000 counts per second, which is approximately ten times higher than the count rates achieved by current commercially-available classification and sorting systems. Further, Si(Li) and high-purity Ge detectors each provide about 50% better resolution than current commercially-available x-ray detectors used in state-of-the-art sorting systems. However, a disadvantage of using Si(Li) or high-purity Ge detectors is that they are cooled using liquid nitrogen.

It should be appreciated that an Si-PIN, Si(Li) or Ge diode detector may be used as x-ray detector 310 with only a single x-ray source and still provide higher counting rates and improved resolution over the x-ray detectors used in current commercially-available sorting systems.

Having described, in detail, embodiments of the invention in which a plurality of x-ray sources are used to stimulate x-rays from a piece, embodiments in which both fluoresced x-rays and emitted optical emissions are used to classify and sort pieces of material will now be described in more detail.

In one or more embodiments of the invention, OES may be used to classify pieces of material containing low-Z elements, for example, in combination with XRF spectroscopy. Any of a variety of types of OES may be used, including, but not limited to, LIBS, ADS and SDS. Using LIBS, a laser may generate a laser beam that vaporizes a portion of the piece of material, producing a plasma that emits optical emissions that are detected and analyzed to classify the piece of material. Using ADS or SDS, described below in more detail, an electrical discharge device may produce an electric discharge that vaporizes a portion of the piece of material, producing a plasma that emits optical emissions that are detected and analyzed to classify the piece of material.

Figure 4:
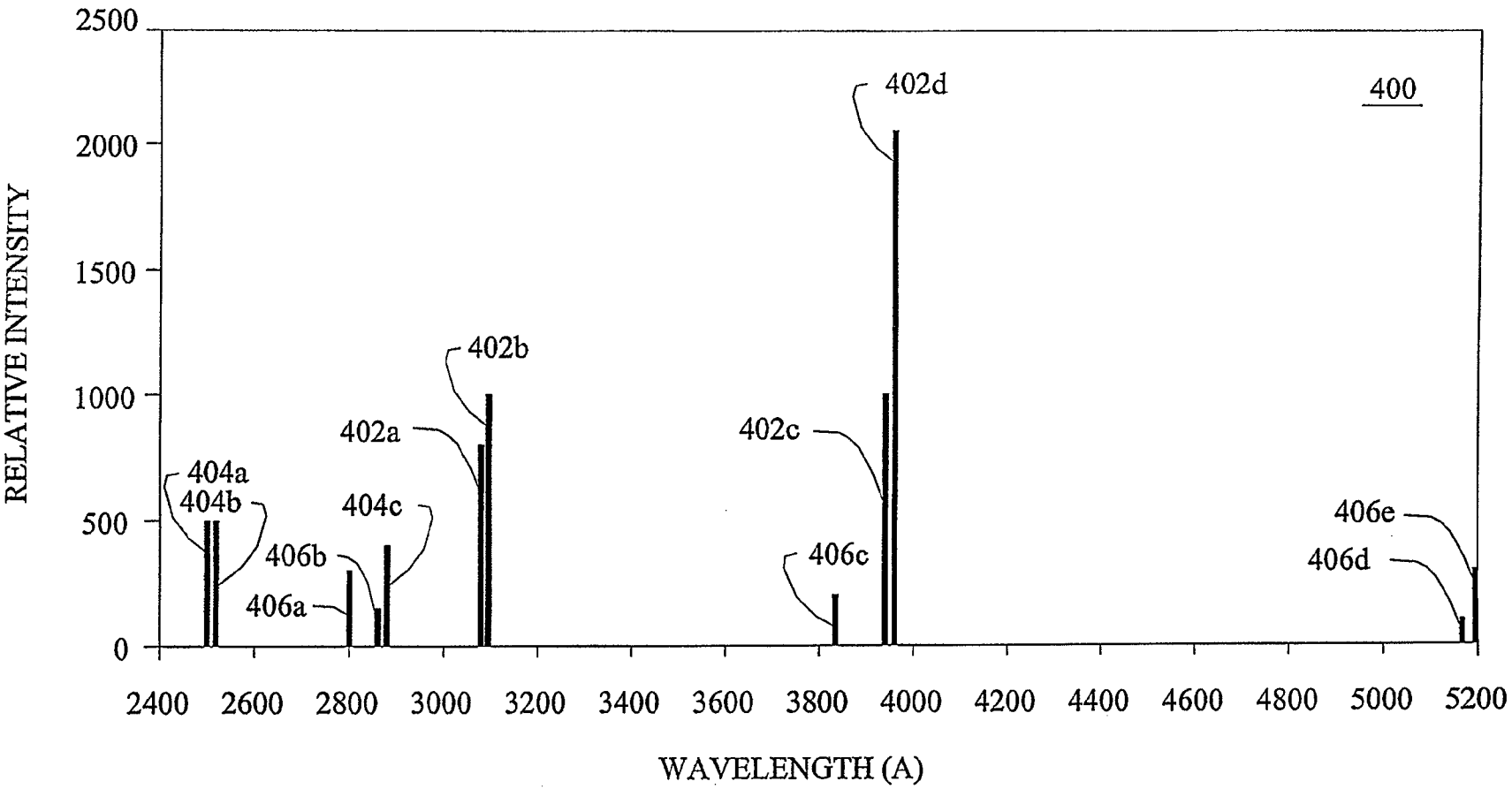
FIG. 4 is a graph illustrating an optical emission spectrum including the optical emission spectra of aluminum, silicon and magnesium resulting from a spark discharge.

FIG. 4 is a graph 400 illustrating an optical emission spectrum including the optical emission spectra of aluminum, silicon and magnesium (silicon and magnesium being common alloying agents of aluminum). Graph 400 does not represent an actual detected spectrum, but a theoretical spectrum based on known data. Graph 400 represents the spectra that may result from vaporizing a piece of material including aluminum, magnesium and silicon using a spark discharge. The relative intensities would vary depending on the relative amounts of each element in the piece. It should be appreciated that the optical emission spectra of these same elements when subjected to a laser beam, as opposed to a spark discharge, should be very similar to those shown in FIG. 4. The data used to create graph 400 may be found in the *CRC Handbook of Chemistry and Physics*, data generated by the National Institute of Standards and Technology (NIST), and other sources known to those of skill in the art. As is shown in FIG. 4, aluminum has prominent emission lines 402*a*, 402*b*, 402*c* and 402*d*. The emission lines are clustered in two groups, a first group at 3082 Å and 3092 Å, and a second group at 3944 Å and 3962 Å, with the second group having the more prominent spectral lines. The silicon lines 404A-404C and the magnesium lines 406A-406E also are prominent, albeit not as prominent as the aluminum lines. The spectral lines of aluminum, magnesium and silicon are relatively well separated. For pieces of material that only emit optical photons from aluminum, magnesium and silicon within the range of wavelengths shown in graph 400, this relatively good separation should enable the optical emissions from the piece to be resolved into an optical emission spectrum from which the presence and relative amounts of aluminum, silicon and magnesium can be determined. Thus, OES works well for specific alloys including only aluminum, silicon and/or magnesium.

Figure 5:
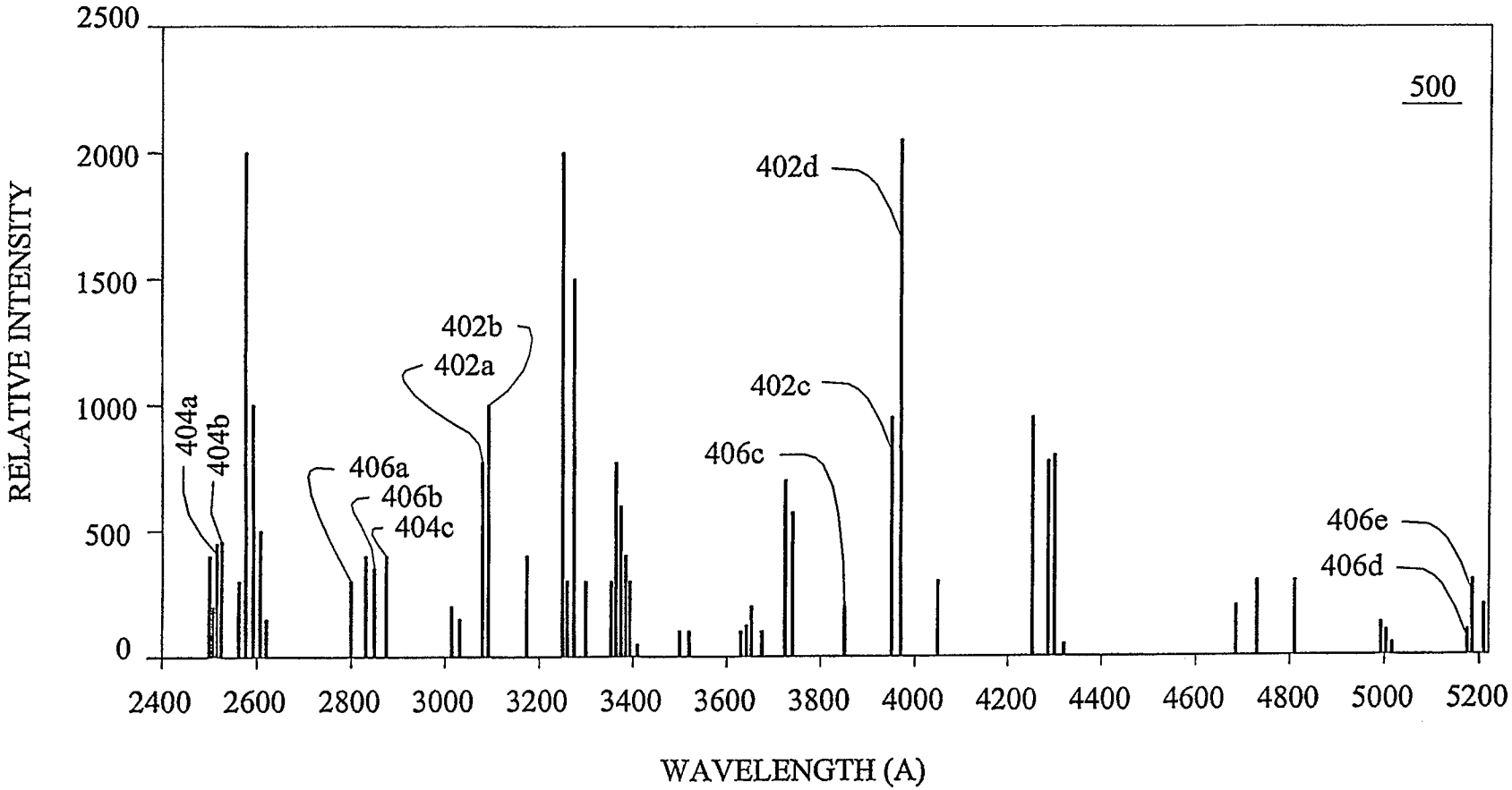
FIG. 5 is a graph illustrating an optical emission spectrum including the optical emission spectra for aluminum, silicon and magnesium along with several other metals.

FIG. 5 is a graph 500 that shows an optical emission spectrum including the optical emission spectra for aluminum, silicon and magnesium along with several other metals, including manganese, copper, zinc, nickel, chromium, lead, tin, titanium and iron, each of which is often found among scrap metals. Analogous to graph 400, graph 500 represents a theoretical spectrum based on known data. As opposed to XRF spectra for metals, in which each metal can be identified with a relatively few prominent spectral lines, FIG. 5 illustrates that the optical emissions spectra for metals is far more complex. This complexity makes somewhat difficult the accurate classification at high speeds of pieces of material including a wide range of these metals. Analysis can be further complicated because surface impurities such as dirt, grease, and oxides on the pieces of material may contribute further spectra in response to being stimulated. Accordingly, it may be desirable to only use OES to identify and classify low-Z elements, while using XRF spectroscopy to identify and classify relatively high-Z elements.

Figure 6:
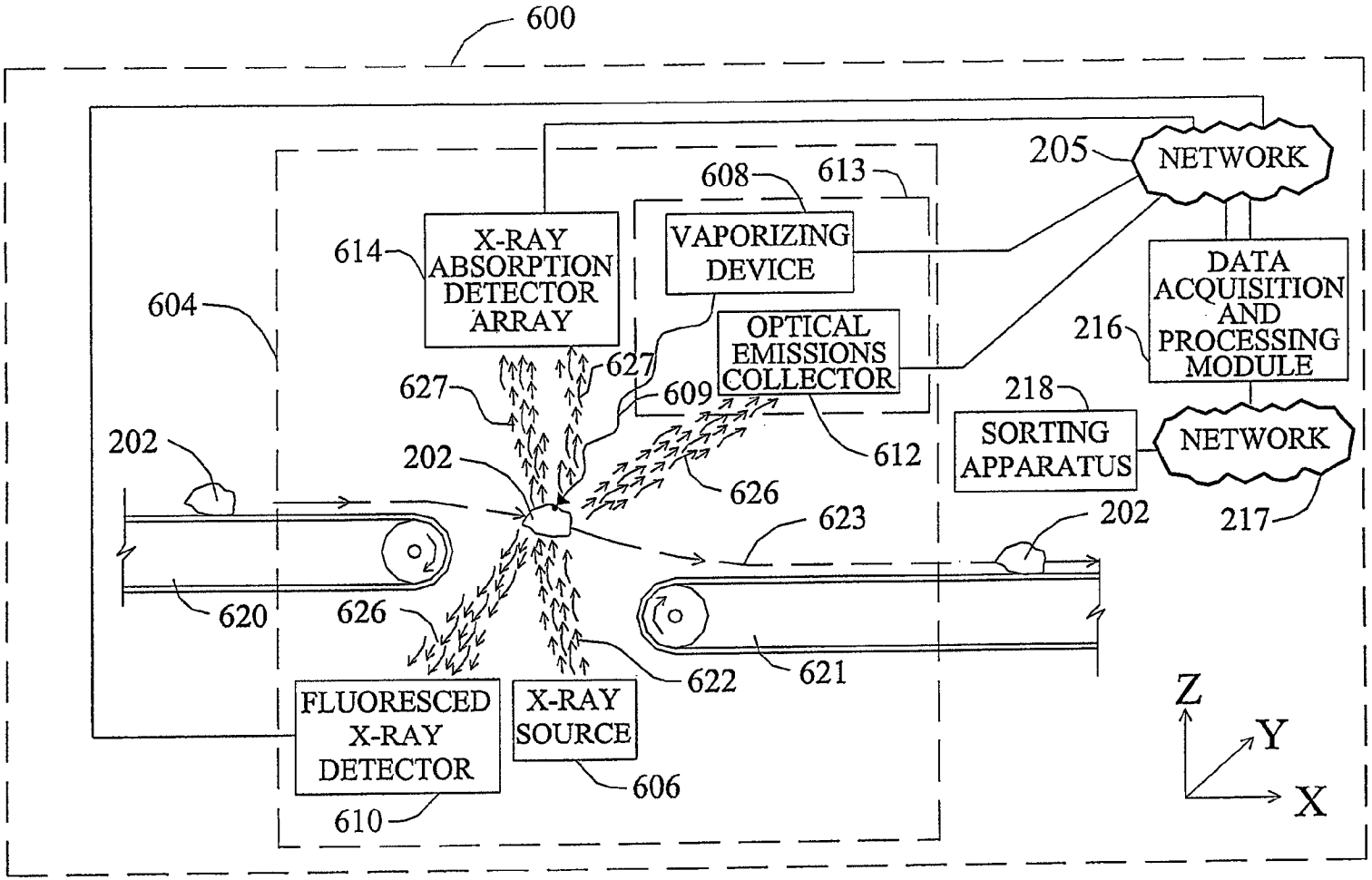
FIG. 6 is a block diagram illustrating an example of a system for sorting pieces of material using a combination of XRF spectroscopy and OES, according to one or more embodiments of the invention.

FIG. 6 is a block diagram illustrating an example of a system 600 for classifying and sorting a piece of material using a combination of XRF spectroscopy and OES. System 600, and system 800 described below, are merely illustrative embodiments of a system for sorting pieces of material using a combination of XRF and OES. Such illustrative embodiments are not intended to limit the scope of the invention, as any of numerous other implementations of a system for sorting pieces of material using a combination of XRF and OES, for example, variations of systems 600 and 800, are possible and are intended to fall within the scope of the invention.

The system 600 may include any of a vaporizing device 608, an x-ray source 606, an optical emissions collector 612, a fluoresced x-ray detector 610 and a x-ray absorption detector array 614, which all may be located within a stimulation and detection area 604, which may be an enclosed area such as a chamber. The system 600 also may include a conveying system that includes a first conveyor belt 602 and a second conveyor belt 621, networks 205 and 217, data acquisition and processing module 216 and sorting apparatus 218.

Following path 623, the pieces of material 202 may be conveyed by the first conveyor belt 620 into stimulation and detection area 604. Within area 604, the piece of material 202 may be launched across an opening between belts 620 and 621, landing on belt 621 and proceeding out of area 604 to be sorted. The surface heights and speeds of conveyor belts 620 and 621 may be configured such that pieces of material land cleanly (i.e., does not bounce or move around after landing) on belt 621. While in area 604, the piece of material 202 may be stimulated by stimulus 609 from a vaporizing device 604, producing optical emissions 626, and may be irradiated with x-rays 622 from x-ray source 606, producing fluoresced x-rays 610. X-ray source 606 may be any of a variety of types of x-ray source, for example, one of the first or second x-ray sources 306 and 308 described above in relation to FIG. 3. The fluoresced x-rays 626 may be detected by a fluoresced x-ray detector 610, which may be any of a variety of types of x-ray detectors, for example, the x-ray detector 310 described above in relation to FIG. 3.

The optical emissions 626 result from the impact on the piece of material 202 by stimulus 609 from vaporizing device 608. The vaporizing device 608 may be any of a variety of types of vaporizing devices, for example, a laser, an electrical discharge (e.g., an arc discharge device or a spark discharge device), another type of device, or any suitable combination thereof. Thus, stimulus 609 may be any of a variety of type of stimulus, for example, a laser beam or an electrical discharge.

It should be appreciated that FIG. 6 is just a schematic representation of system 600. Accordingly, elements 606, 608, 610, 613 and 614 may be arranged and positioned in any of a variety of configurations other than that shown in FIG. 6. For example, one or more of the components 608, 612 and 614 shown above path 623 may be located below path 623, and any of components 606 and 610 located below path 623 may be located above path 623.

In an embodiment where the vaporizing device 608 is a laser or other light source, the stimulus 609 may be focused at a certain distance from vaporizing device 608. For example, the vaporizing device 608 may be configured to focus stimulus 609 on each piece of material 202 using known auto focus or sonar techniques. Because each piece of material 202 may be of a different size and shape, each piece of material 202 may be a different distance from vaporizing device 608 as it passes between belts 620 and 621. In one or more embodiments, the vaporizing device 608 and the optical emissions collector 613 may be located beneath path 623. Locating the vaporizing device 608 beneath path 623 provides a relatively constant distance between the vaporizing device 608 and pieces 202 as they pass between belts 620 and 621. Accordingly, the vaporizing device could be pre-set to focus at a constant distance as opposed to being re-focused for each piece 202.

In embodiments where it is desired to know the position of the piece of material in the x-y plane during its in-flight trajectory, the x-ray absorption detector array 614 may be used as a position detection device. It should be appreciated that any of a variety of other types of to position detecting devices may be used, for example, an image detector. The x-ray absorption detector array 614 may be positioned above the piece's trajectory path 623 for monitoring x-rays 627 emitted from the x-ray source 606. Alternatively, the x-ray absorption detector array may be located below the path, for example, if an x-ray source is located above the path. As a piece passes between the detector 614 and the source 606, the x-ray absorption detector array 614 may detect when a front edge of a piece 202 passes between x-ray source 606 and detector array 614. Further, the detector array 614 may detect the position of the piece in the x-y plane. The detector array 614 detects decreases in the amount of detected x-rays 627 at different locations on the bottom x-y face of the detector array 614. In other words, the passing piece 202 casts a sort of x-ray "shadow" on the bottom x-y face of the detector array 614. The x-ray absorption detector array 614 may send this transmitted x-ray information over network 205 to data acquisition and processing module 216. Module 216 then may analyze the data and determine the position of the piece in the x-y plane.

This x-y positional information may be used to control operation of the optical emissions collector 612 to aim it at the location at which the luminous plasma is formed on the piece's surface, from which the optical emissions 626 are detected. Further, the detection by detector array 614 of the leading edge of piece 202 passing between detector array 614 and x-ray source 606 may be used to initiate a laser or other vaporizing device 608 to generate a laser beam pulse to stimulate the piece. This information also may be used to trigger the aiming of the laser beam pulse and/or emissions collector 612.

In one or more embodiments, system 600 may include a means for aligning pieces 202 along the approximate center of belt 620 in the y-direction or some other predetermined location in the y-direction. Aligning the pieces of material ensures that each piece is conveyed along belt 620 at a predefined position along the y-direction, and therefore launches across the air gap at a predetermined location along the y-direction. Aligning pieces in this fashion obviates the need for a position detection device such as the x-ray absorption detection array 614. For example, system 600 may include a materials feeder that feeds each piece of material 202 onto belt 620 at a predefined position in the y-direction.

The optical emissions collector 612 may be any of a variety of types of optical emissions collectors. The collector 612 may include one or more light-collection lenses, which serve to collect the optical emissions 626 on one or more fiber optic strands. These fiber optic strands may be part of a fiber optics cable that passes the collected optical emissions through network 205 to data acquisition and processing module 216. As described in more detail to below in relation to FIG. 7, in one or more embodiments, the fiber optic cable that carries the collected optical emissions may also include one or more fiber optic strands that delivers the laser beam pulse that stimulates the piece 202.

Figure 7:
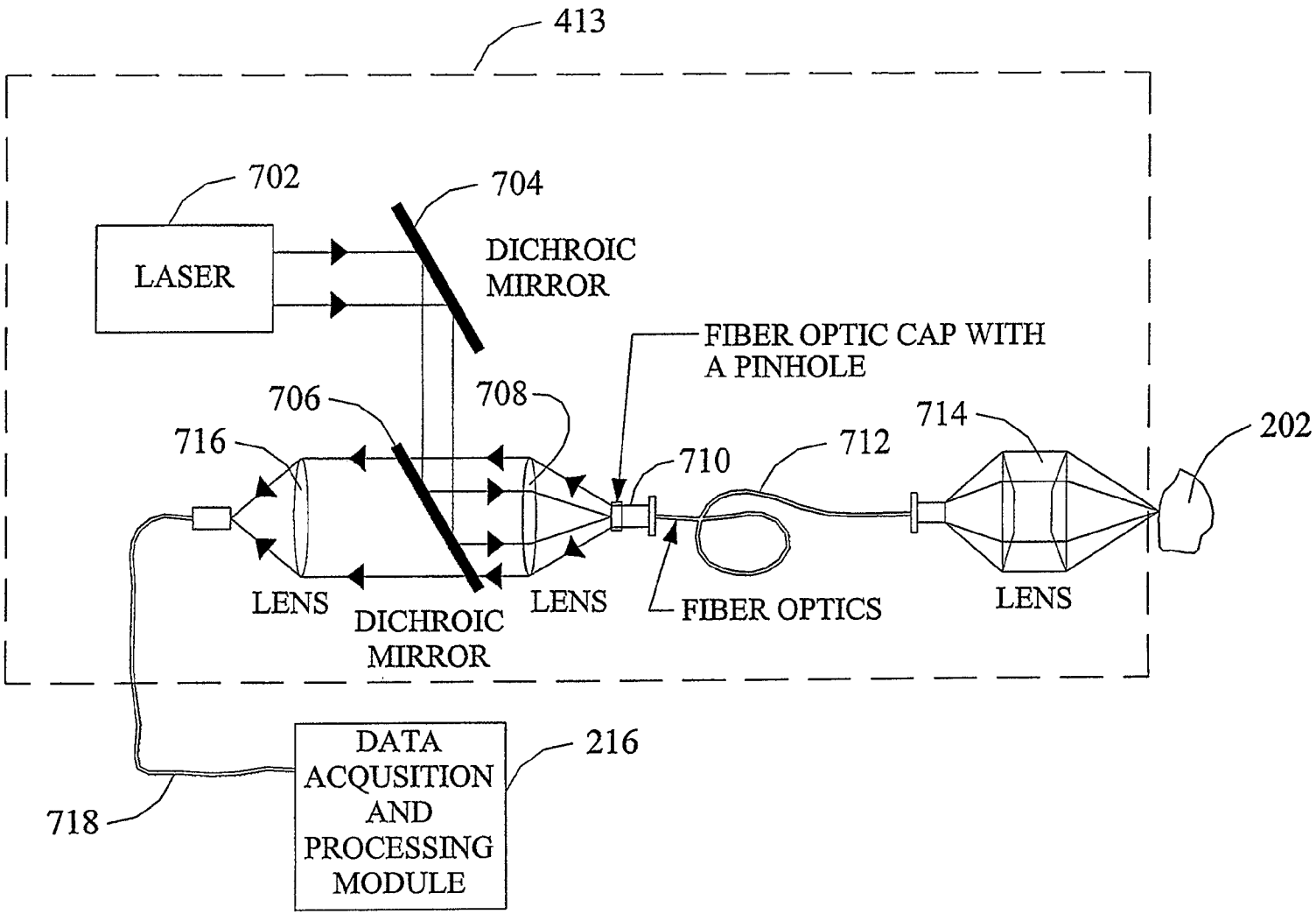
FIG. 7 illustrates an example of a vaporizing and detecting unit used as part of a material sorting system, according to one or more embodiments of the invention.

As illustrated in FIGS. 6 and 7, in one or more embodiments, the pieces of material are launched (i.e., passed through the air) from conveyor belt 620 to conveyor belt 621. Passing a piece of material 202 from the first belt 620 to the second belt 621 allows the x-ray source 606 and the fluoresced x-ray detector 610 to be disposed relatively close to the piece of material 202 being stimulated. This relatively close spacing enables more x-rays 622 emitted from the x-ray source to reach the piece 202 before being absorbed in air, particularly x-rays fluorescent from low-Z elements. Further, the fluoresced x-ray detector 610 can detect more fluoresced x-rays 626 before the fluoresced x-rays are absorbed in air, particularly x-rays fluorescent from low-Z elements. Another advantage of using two-belts in this fashion is that x-rays from the x-ray source 606 may be collimated and aimed so that they intersect the piece's trajectory and pass into the space above the pieces trajectory. In this space above the trajectory, the x-rays may be absorbed by air or by an x-ray chamber or other enclosure that may enclose area 604. Such absorption reduces an amount of background radiation that otherwise may be present if the stimulation sources and emissions detectors are located above the stimulation location.

Further, as described above, such a two-belt system enables any of the vaporizing device 608 (e.g., a laser and/or other optics) and the optical emissions collector 612 to be placed beneath path 623, thereby providing a relative constant distance between these devices and pieces being stimulated. Accordingly, the need to re-focus the vaporizing device 608 and/or the optical emissions detector 612 for each piece may be obviated.

It should be appreciated that the system 600 is not limited to the two-belt embodiment illustrated in FIG. 6. The conveying system of system 600 may have any of a plurality of other suitable configurations, such as those described above. For example, the conveyor system may include a single belt that includes windows and/or open areas (e.g., mesh). Further, the conveyor system may include two belts having a same surface height, where the distance between the belts is configured to be too small to allow a piece to fall between. These two belts also may be configured to prevent a piece from being jostled during transition between the two belts.

It should be appreciated that although the two-belt system is described in relation to using a combination of XRF spectroscopy and OES as shown in FIG. 4, the use of a two-belt system is not limited thereto. Such a two-belt system may be used even if there is only one to stimulus source, for example, an x-ray source, or only one emissions detector, for example, a fluoresced x-ray detector. Such embodiments still would have the above-described benefits resulting from being able to place the x-ray source and the fluoresced x-ray detector at a relatively close proximity to the piece of material being irradiated.

In one or more embodiments, the vaporizing device 608 and the optical emissions collector 612 may be integrated within a same vaporizing and detecting unit 613, for example, when a laser is used as the vaporizing device.

FIG. 7 illustrates an example of a vaporizing and detecting unit 613 used as part of system 600. Vaporizing and detecting unit 413 is merely an illustrative embodiment of a vaporizing and detecting unit. Such an illustrative embodiment is not intended to limit the scope of the invention, as any of numerous other implementations of a vaporizing and detecting unit, for example, variations of unit 413, are possible and are intended to fall within the scope of the invention.

A laser 702 emits a laser beam pulse (i.e., a pulse of light) that is reflected off a first dichroic mirror 704 and then reflected off a second dichroic mirror 706. The light reflected from second dichroic mirror 706 is then focused by lens 708 on a fiber optic cap with a pinhole 710, which is connected to fiber optic cable 712. The light passes through fiber optic cable 712 and impacts a lens 714 that produces the light that impacts the piece of material 202.

As indicated by the arrows throughout FIG. 7, the photons emitted from the piece of material 202 then may be passed back through many of the same components through which the light of the laser beam passed before hitting the piece of material. Thus, fiber optics cable 712 may include one or more strands that transmit the light that impacts the piece of material 202 and one or more strands that transmit the optical emissions emitted from the piece. Accordingly, the emitted photons pass back through lens 714, through fiber optics cable 712, through lens 708 and into lens 716. Lens 716 focuses the emitted photons onto a fiber optic cable 718, which leads to data acquisition and processing module 216. It should be appreciated that other embodiments of a vaporizing and detecting unit may be used.

The vaporizing device 608 of FIG. 6 and/or the laser 702 may be configured to generate multiple pulses of light with each piece of material. For example, the first one or more pulses may be used to vaporize surface contaminants (e.g., oxides) from the surface of the piece being eradiated. After the service contaminants have been cleared by the first one or more pulses, the last pulse may be used to vaporize a portion of the piece of material to produce the optical emissions on which the classification on which the piece is based. Accordingly, system 600 may include control circuitry control the timing of the detection of optical emissions to coincide with the pulse that vaporizes a portion of the piece of material, as opposed to mere surface contaminants on the piece of material. Such control logic may reside within the data acquisition and processing module 216, within the vaporizing and detecting unit 413, within another component, or may be shared between one or more components of system 600.

Figure 8:
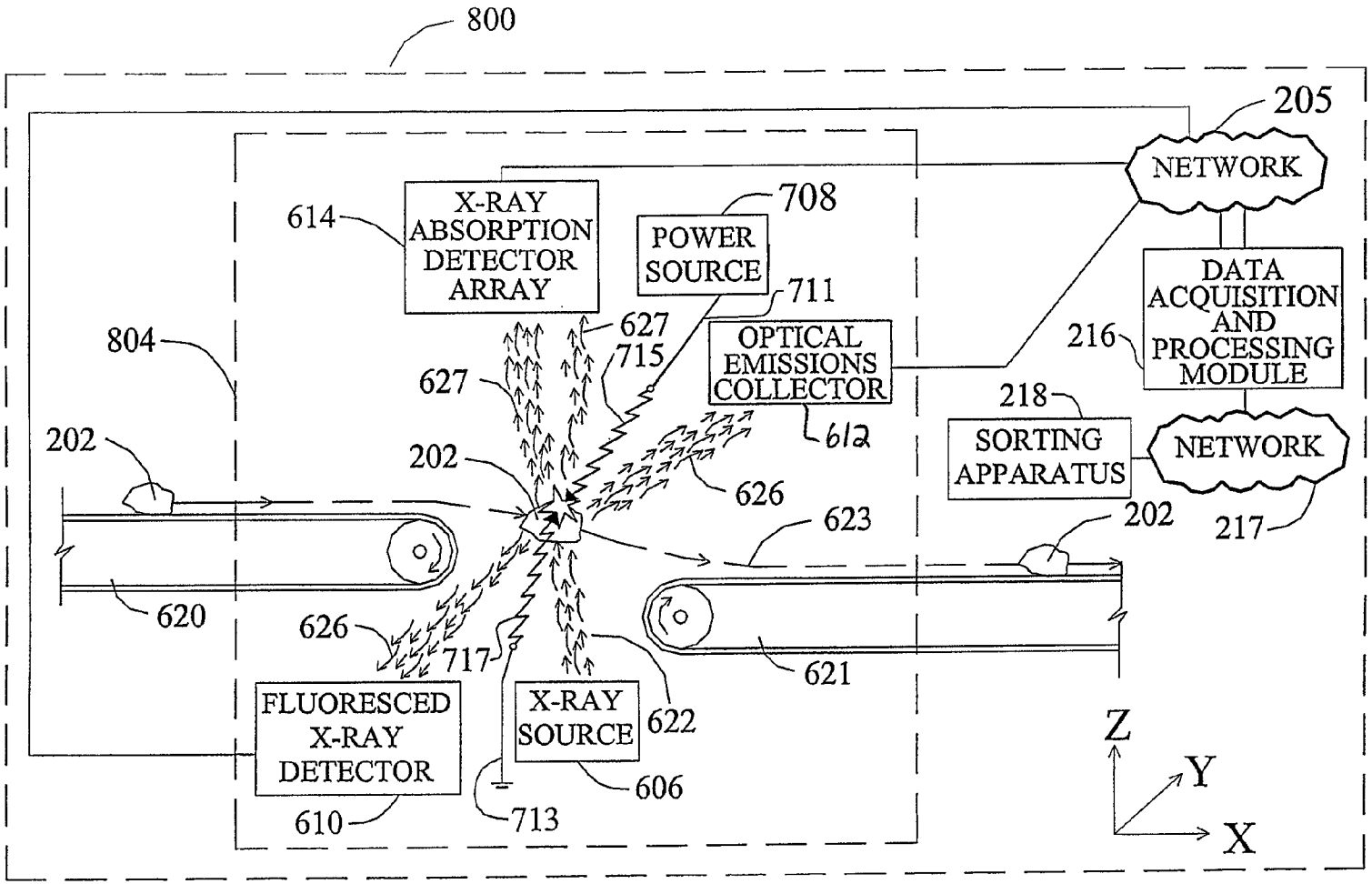
FIG. 8 is a block diagram illustrating an example of a system for sorting pieces of material using a combination of XRF spectroscopy and spark discharge spectroscopy or arc discharge spectroscopy, according to one or more embodiments of the invention.

FIG. 8 is a block diagram illustrating an example of a system 800 for classifying and sorting pieces of material 202 using XRF spectroscopy and Arc Discharge Spectroscopy (ADS). System 800 includes several of the same components described above in relation to FIG. 6. Instead of having a vaporizing device 608, for example, a laser, system 800 includes an arc discharge device which includes a power source 708 and electrodes 711 and 713. Power source 708 is enabled to build up a charge between nodes 711 and 713. When a piece 202 is not present between electrodes 711 and 713, the charge remains on the electrodes because the air between the electrodes serves as a dielectric. When a piece 202 passes between electrodes 711 and 713, a conductive path is created between the electrodes causing electric discharge 715, 717 to vaporize a portion of piece 202. The vaporized portion becomes a plasma that emits optical emissions 626.

In one or more other embodiments, spark discharge spectroscopy (SDS) may be used instead of ADS. In contrast to ADS, in SDS a spark is continually present between electrodes 711 and 713 (e.g., similar to a welding gun). The spark vaporizes a portion of piece 202 as it passes on the producing plasma which emits the optical emissions 626. SDS, which often is used in a laboratory environment, typically requires operation in less than an atmosphere of pressure, for example in Argon. Further, SDS typically is slower in classifying materials than ADS. Accordingly, it may be desirable to use ADS over SDS.

Figure 9:
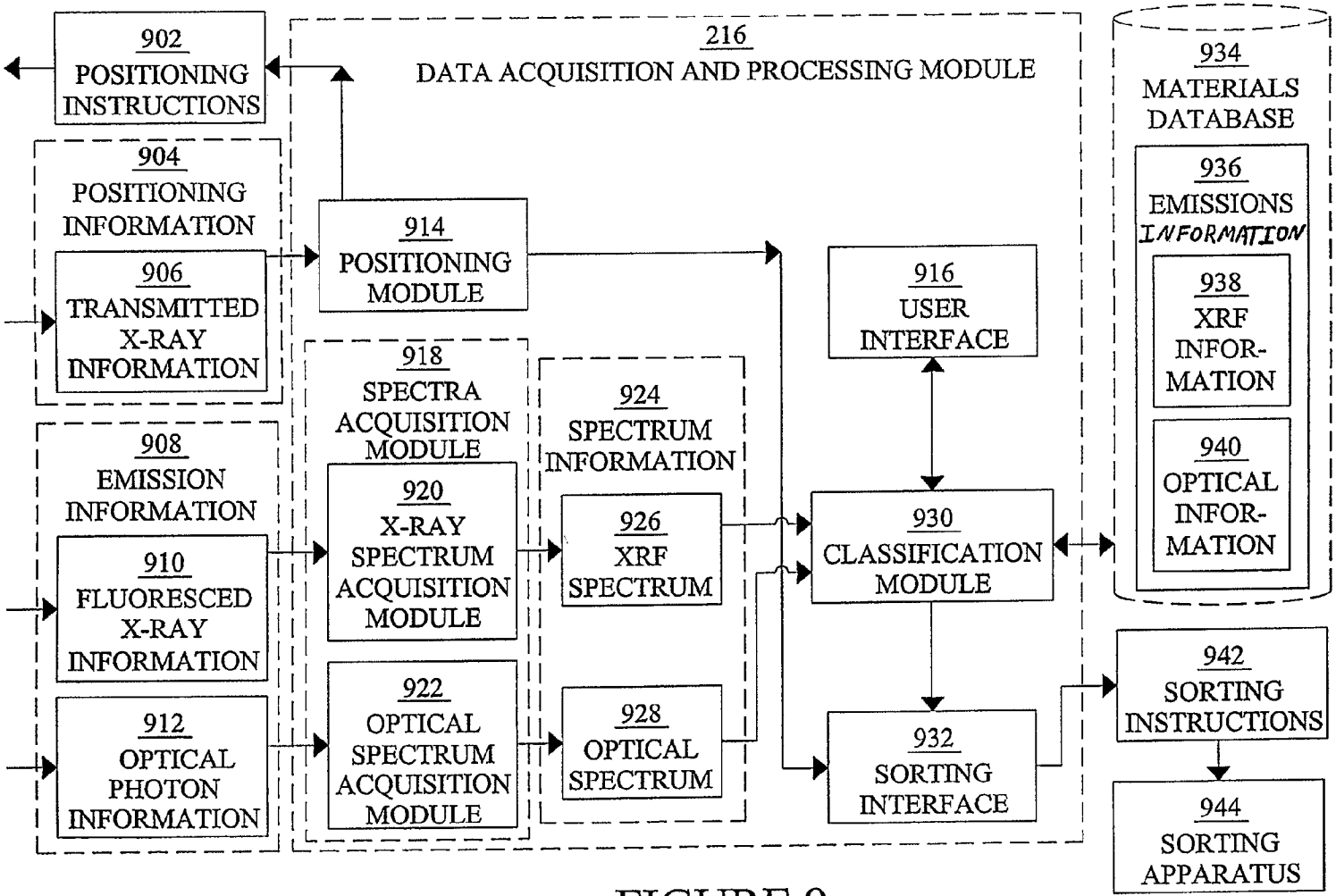
FIG. 9 is a data flow diagram illustrating an example of a data acquisition and processing module, according to one or more embodiments of the invention.

FIG. 9 is a data flow diagram illustrating an example of the data acquisition and processing module 216. The data acquisition and processing module 216 may include any of positioning module 914, user interface 916, spectrum acquisition module 918, classification module 930 and sorting interface 932. The positioning module 914 may receiving positioning information 904, for example, from position detection device 214. In an embodiment, the positioning information 904 includes transmitted x-ray information 906, which may be received from x-ray absorption detector array 614. The positioning module 914 analyzes the positioning information 904 and generates positioning instructions 902. Positioning instructions 902 may be sent to one or more components within the detection area, for to example, a vaporizing device such as a laser and one or more optical emissions collectors (e.g., 310 or 610). Positioning instructions 902 may be used by the vaporizing device to aim its stimulus at pieces of material. Optical emissions collectors may use instructions 902 to aim their detection of emissions from the piece 202, as described above in relation to FIG. 6.

Further, the positioning module may provide information to the sorting interface 932 based on the positioning information 904, and the sorting interface may use this information to time sorting instructions 942 for the sorting apparatus 944.

The spectra acquisition module 918 may receive emission information 908 from one or more emission detectors. This emission information may include any of fluoresced x-rays information 910, optical photon information 912 and other types of emissions information. The spectra acquisition module may include an x-ray spectrum acquisition module 920 for acquiring and processing the fluoresced x-rays information 910 to produce XRF spectrum 926. The x-ray spectrum acquisition module may include amplification logic to amplify the fluoresced x-rays information 910 (e.g., x-ray pulses received from an x-ray detector) into an amplified signal. The spectrum acquisition module may include a multichannel analyzer, for example, the Amptech MCA 5000 acquisition card and software, which has 2048 channels for dispersing x-rays into a discrete energy spectrum with 2048 energy levels. In other embodiments, the spectrum acquisition module may include a multi-channel analyzer which has 1024 channels (or even less) for dispersing x-rays into a discrete energy spectrum. The multi-channel analyzer may convert the amplified analog signal into one or more digital signals representing the XRF spectrum 926. The determined XRF spectrum 926 may be sent to classification module 930.

The spectrum acquisition module 918 also may include an optical spectrum acquisition module 922, which may receive optical photon information 912 and produce an optical spectrum 928. The optical photon information 912 may be received from optical emissions collector 412 or a similar component. The optical spectrum acquisition module 922 may be any of a variety of types, for example, an OES spectrometer.

It should be appreciated that each of x-ray spectrum acquisition module 920 and optical spectrum acquisition module 922 may be discrete components separate from one another and separate from the data acquisition and processing module 216. In such an embodiment, each device may be connected to the data acquisition of processing module 216 by one or more network segments, for example, a wire, cable or wireless connection.

The spectrum information 924, which may include any of XRF spectrum 926 and optical spectrum 928, is sent to classification module 930. Classification module 930 may employ classification techniques, and may be configured to implement any of Acts 1104-1110, described below in relation to Act 1100. The classification module 930 may compare the spectrum information 924 to emissions information 936 stored in materials database 934, which may reside on a same or different device than classification module 930. The emissions information 936 may include XRF information 938 and optical information 940. The XRF information 938 may include a library of reference spectra and/or a reference ROI vectors. The optical information 940 may include a library of optical spectra and/or reference ROI vectors. By comparing the spectrum information 924 to the emissions information 936, the classification module may determine a best match for the piece of material, or that there is no match, and provide the appropriate information to the sorting interface 932. The sorting interface 932 then may provide the sorting instructions 942 to the sorting apparatus 944 in accordance with the classification.

Figures 14A, 14B:
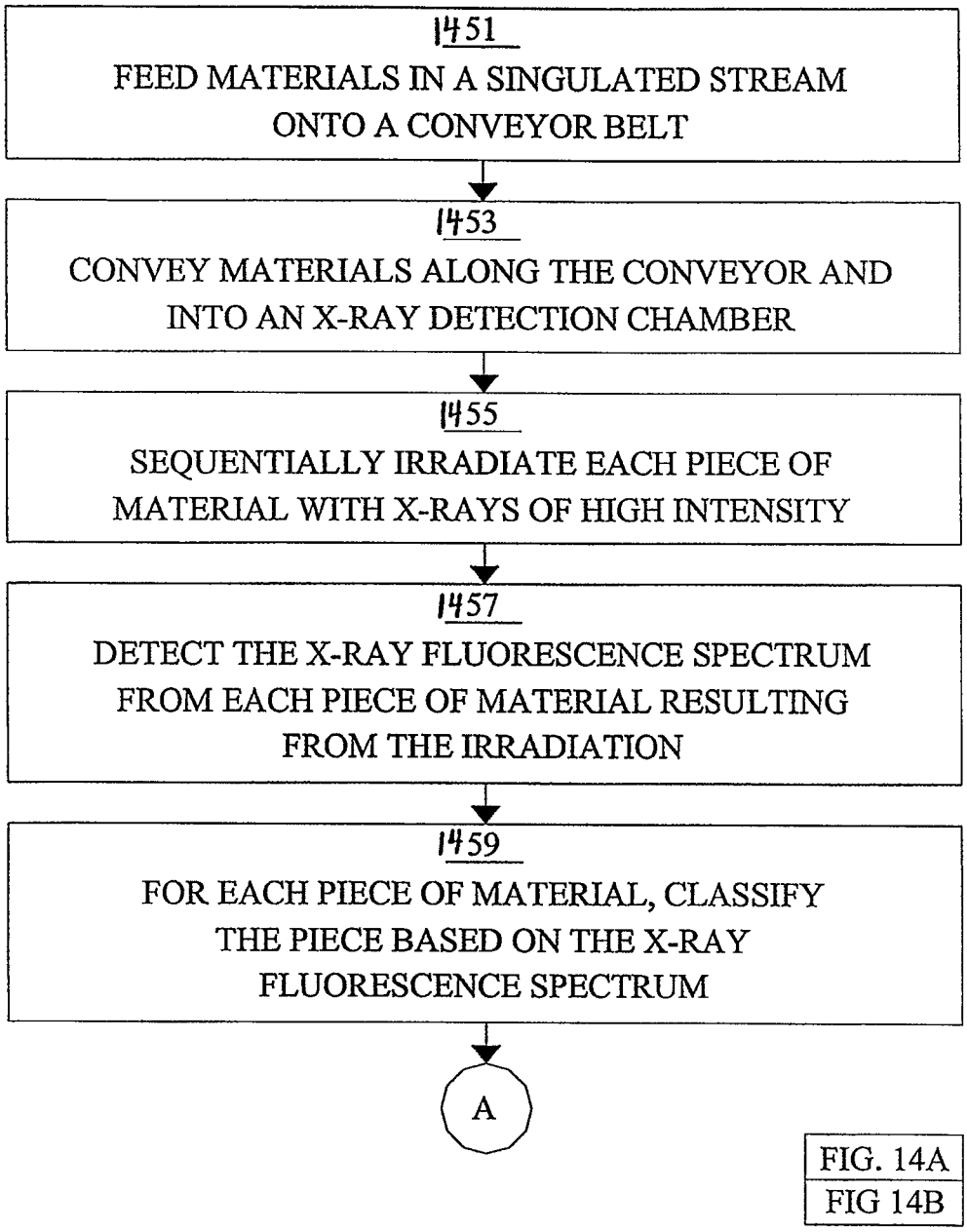
FIGS. 14A and 14B are a flow chart showing an illustrative embodiment of a process of sorting pieces of material at high speed.
Figure 14B:
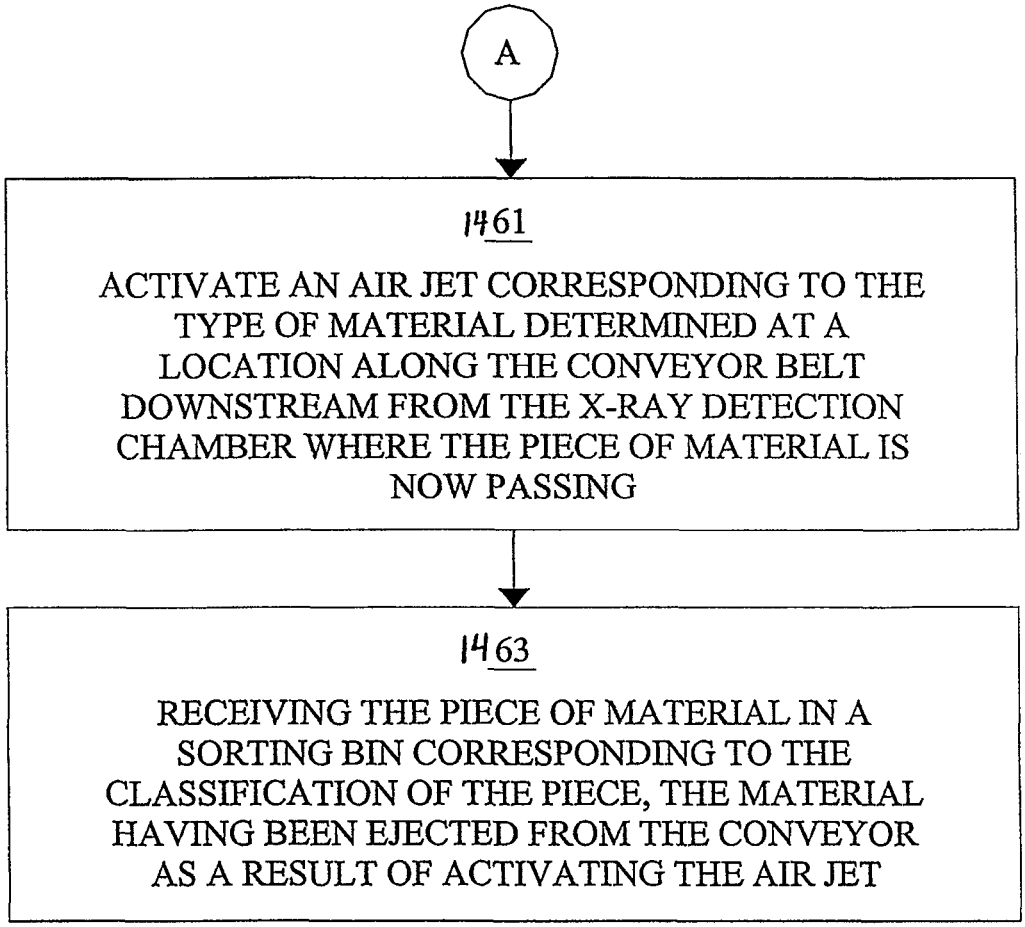
Figure 15:
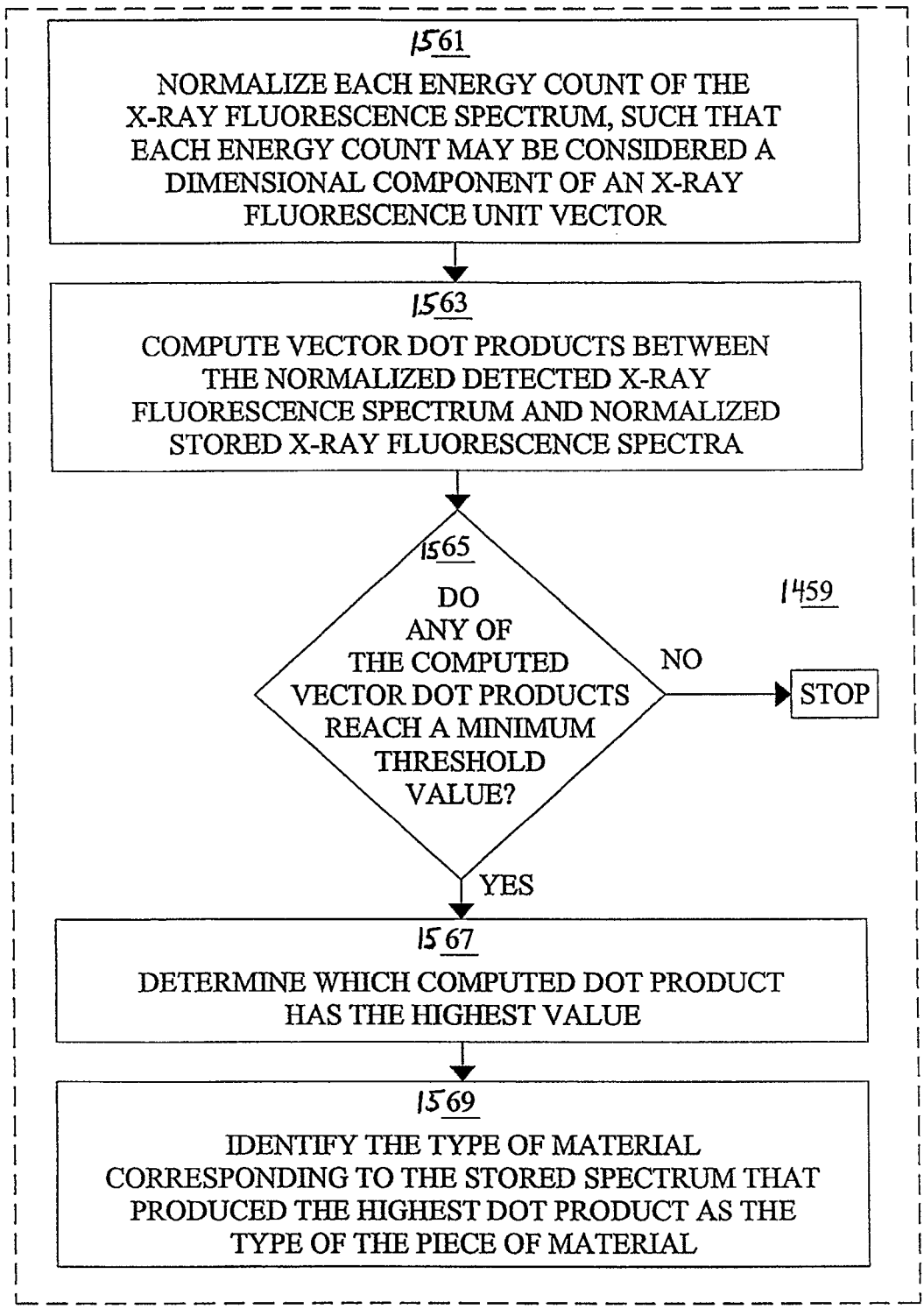
FIG. 15 is a flow chart showing an illustrative embodiment of a process for classifying a piece of material based on the x-ray fluorescence spectrum of the piece.

The classification module 930 may be configured to classify materials using any of a plurality of types of techniques, for example, as described in the Sommer patent in relation to step 59 in FIGS. 2a, 2b, and 6 of that patent, and described more fully at the end of the present specification in relation to FIGS. 14A, 14B, and 15.

In one or more embodiments, the XRF information 938 and the optical information 940 are not separated collections of information, but are one integral collection of information. For example, for a given reference material, a reference spectra and/or reference ROI vectors may include both optical and XRF information.

In one or more embodiments, the classification module 930 may be configured to use the sorting bins to create alloys. For example, classifications may be mapped to sorting bins to collect the raw materials from which an alloy or other combinations of materials may be created. The classification module 930 may be configured (e.g., programmed) with the percentage composition of constituent elements of alloys or other compound materials. Each alloy or compound material may be mapped to a particular sorting bin. The classification module 930 may be configured to instruct the sorting apparatus (e.g., through a sorting interface 932) to sort pieces of material containing one or more of the constituent elements into the appropriate bin. The percentages of each constituent sorted into a sorting bin may be monitored. For example, for each sorting bin, the classification module 930 may ensure that the sorting bin has the appropriate percentages of each constituent element when the sorting process is complete and/or when the sorting bin is full. To ensure that the proper percentages of elements are sorted into each bin, the system 200 may include means for determining the mass and/or size of each piece of material, for example, using an image sensor, a weight sensor, an x-ray absorption detector array, other devices, or any suitable combination thereof. Using its knowledge of the mass of each piece of material and the piece's determined classification, the classification module 930 can control over time the percentage amounts of the elements sorted into each bin.

The user interface 916 provides an interface between a human user and the classification module, enabling communication between the user and the classification module. The user interface 916 may be an application or part of an application (i.e., a set of computer-readable instructions) in communication with any of a variety of types of user devices, including a display screen, a mouse, a keyboard, a keypad, a track ball, a microphone (e.g., to be used in conjunction with a voice recognition system), a speaker, a touch screen, a game controller (e.g., a joystick), other user devices and any suitable combination thereof. The user interface 916 may be configured to provide a user interface display on a display device, for example, any of the user interface displays illustrated in FIGS. 7 and 8 of the Sommer patent in the manner described in the Sommer patent.

In one or more embodiments, no optical photon information 912 and/or positioning information 904 may be received by module 216. In such embodiments, module 216 may not include optical spectrum acquisition 922 and/or positioning module 914. Alternatively, these components may be disabled, turned off or not used.

Data and acquisition module 216, and components thereof may be implemented using software (e.g., C, C#, C++, Java, or a combination thereof), hardware (e.g., one or more application-specific integrated circuits), firmware (e.g., electrically-programmed memory) or any combination thereof. One or more of the components of module 216 may reside on a single device, or one or more components may reside on separate, discrete device. Further, each component may be distributed across multiple devices, and one or more of the devices may be interconnected.

Further, on each of the one or more devices that include one or more components of module 216, each of the components may reside in one or more locations on the device. For example, different portions of the components 914, 916, 930 and 932 may reside in different areas of memory (e.g., RAM, ROM, disk, etc.) on the device. Each of such one or more devices may include, among other components, a plurality of known components such as one to or more processors, a memory system, a disk storage system, one or more network interfaces, and one or more busses or other internal communication links interconnecting the various components.

Module 216 may be implemented on a computer system described below in relation to FIGS. 12 and 13.

Module 216 is merely an illustrative embodiment of a module for acquiring emissions information and classifying pieces of material based on such information. Such an illustrative embodiment is not intended to limit the scope of the invention, as any of numerous other implementations of a module for acquiring emissions information and classifying pieces of material based on such information, for example, variations of module 216, are possible and are intended to fall within the scope of the invention.

Those of skill in the art should appreciate that the various settings and parameters of the components of systems 200, 300, 600, 700. 800 and 900, including data acquisition and processing module and its components, may be customized, optimized and reconfigured over time based on the types of materials being sorted, the desired sorting results, the type of equipment being used, empirical results from previous sorts, data that becomes available and other factors.

Figure 10:
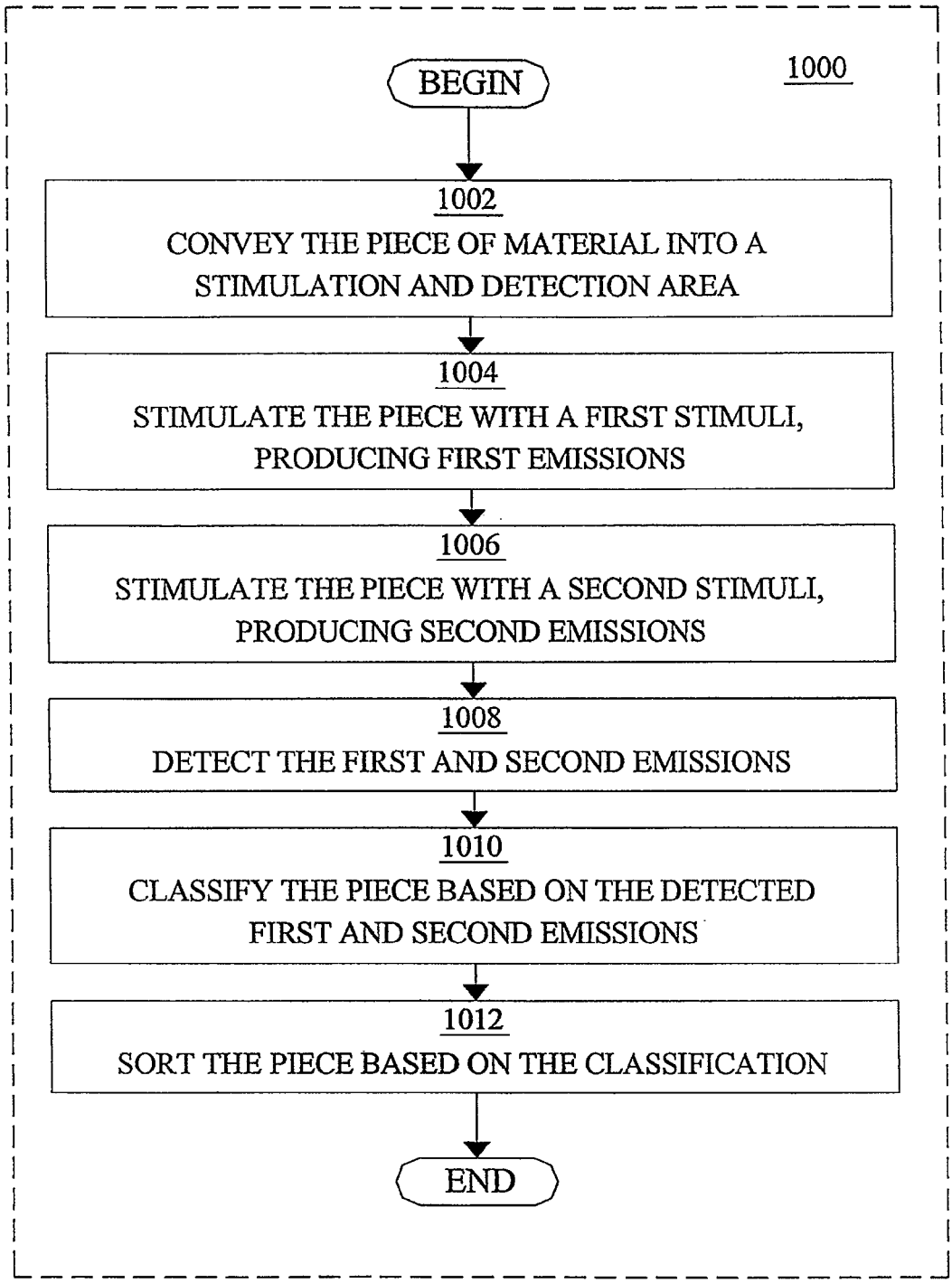
FIG. 10 is a flow chart illustrating an example of a method of sorting a piece of material using a plurality of sources of stimulation, according to one or more embodiments of the invention.

FIG. 10 is a flow chart illustrating an example of a method 1000 for classifying and sorting a piece of material using a plurality of sources of stimulation.

In Act 1012, the piece may be sorted based on the classification, for example, by activating an air jet or other mechanism for removing a piece of material from the conveying system into an appropriate location, for example, a sorting bin. Any of a variety of techniques may be used to sort based on the classification, for example, using any of the techniques described above.

In Act 1006, which may be performed concurrently to performance of Act 1004, the piece is stimulated with a second stimulus, producing second emissions. This second stimulus also may be any of a variety of types of stimuli. Either of the first or second stimulus may be produced by one of first stimulus source 206, second stimulus source 208, first x-ray source 306, second x-ray source 308, x-ray source 406 or vaporizing device 408, described above in relation to FIGS. 2, 3 and 6-8.

In one or more embodiments, the first stimulus and the second stimulus are of the same type, for example, x-rays. In other embodiments, the first stimulus and the second stimulus may be different types of stimuli. In an embodiment in which the first stimulus and the second stimulus are both x-rays, each stimulus may emit x-rays within different ranges, for example, as described above. Further, one of the first or second stimulus may be more intense (i.e., have a higher count rate) than the other stimulus, for example, as described above.

In Act 1008, the first and second emissions are detected. It should be appreciated that act 1008 or portions thereof may occur concurrently with the performance of either of Acts 1004 or 1006. Act 1008 may be performed by a single detector if the first and second emissions or of a same type, for example, the first detector 210 of FIG. 2. Alternatively, one or more emissions detectors may be used to detect the first and second emissions even if they are of the same type. Alternatively, if the first and second emissions are of different types, than a plurality of emissions detectors, for example, fluoresced x-ray detector 410 and optical emissions collector 413 described above in relation to FIG. 4, may be used to detect the first and second emissions.

In Act 1010, the piece may be classified based on the detected first and second emissions. For example, as described above in relation to FIG. 9, spectrum information 924, which may include XRF spectrum 926, an optical spectrum 928 or combination thereof, may be received. Emissions information (e.g., information 936), which may be stored in a database (e.g., materials database 934) may be used to classify the piece of material. The piece may be classified using any of a plurality of types of techniques, for example, as described below in relation to FIG. 11, or as described in the Sommer patent in relation to step 59 with reference to FIGS. 2a, 2b and 6.

In Act 1012, the piece may be sorted based on the classification, for example, for activating an air jet or other mechanism for removing a piece of material from the conveying system into an appropriate location, for example, a sorting bin. Any of a variety of techniques may be used to sort based on the classification, for example, using any of the techniques described above.

Figure 11:
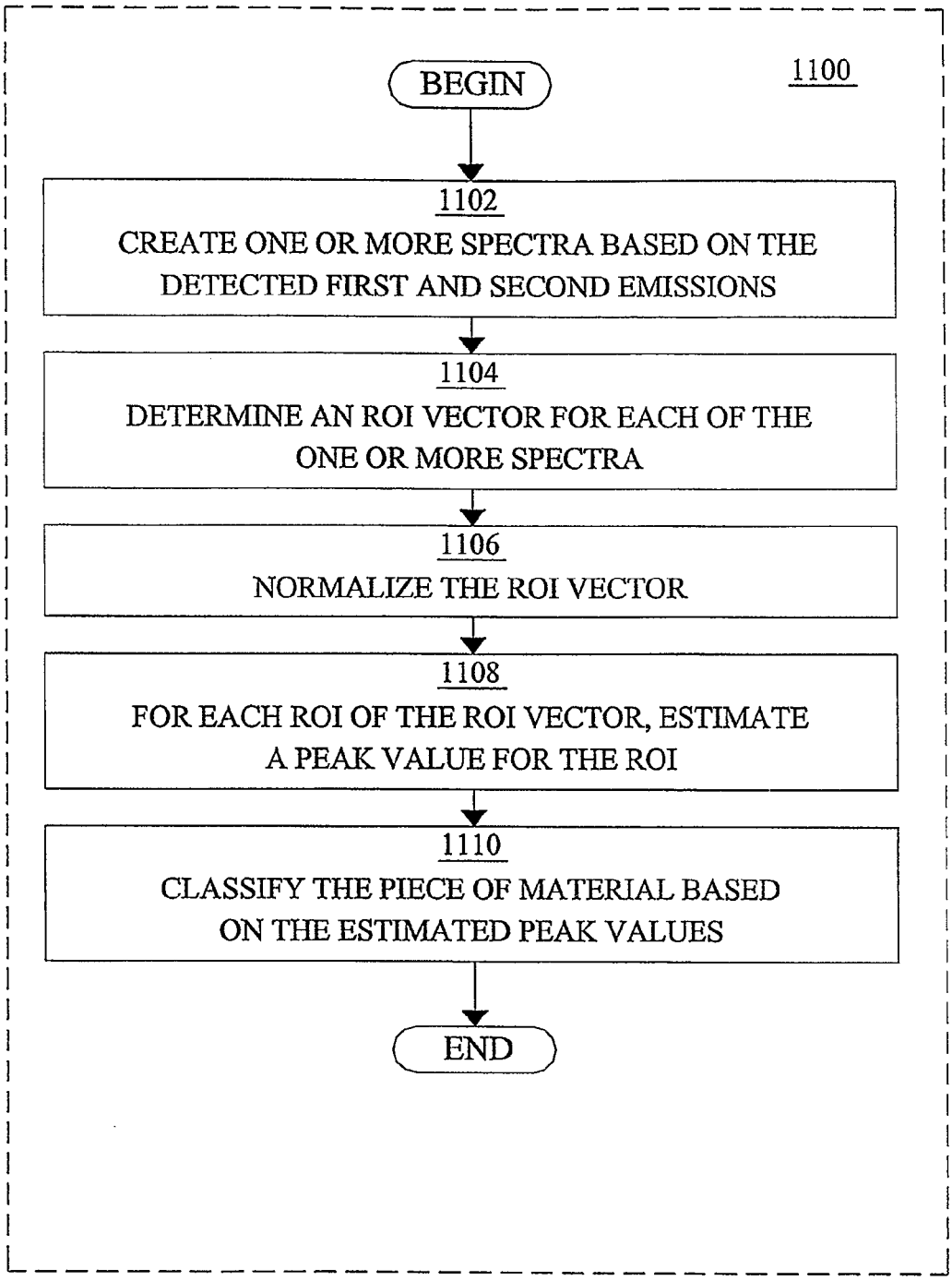
FIG. 11 is a flow chart illustrating an example of a method of classifying a piece of material using by estimating peak values for regions of interest, according to one or more embodiments of the invention.

FIG. 11 is a flow chart illustrating an example of a method 1100 of classifying a piece of material by estimating peak values for regions of interest.

In Act 1102, one or more spectra may be built based on the detected first and second emissions. For example, if the first and second emissions are both x-rays, then a single x-ray spectrum 926 may be generated by x-ray spectrum acquisition module 920. Alternatively, if the first and second emissions include x-rays and optical emissions, then x-ray spectrum acquisition module 920 may build XRF spectrum 926, and optical spectrum acquisition module 922 may build optical spectrum 928. Further, a single spectrum may be built that includes both XRF and optical emissions data.

In Act 1104, a region of interest (ROI) vector may be determined for each of the one or more spectra. Although a determined spectra may include discrete energy counts spanning a wide range of energy levels and/or wavelengths, it may be that only certain energy levels or wavelengths are of interest in classifying a piece of material. Such energy levels and/or wavelengths may serve to distinguish classes of materials from one another. However, even though the specific energy levels and wavelengths at which elements produce emissions can be used to distinguish classes of materials, the equipment used to capture emission spectra (e.g., XRF detectors, optical emissions collectors, and XRF and optical acquisition modules) are imperfect devices. Thus, the captured emissions spectra may not perfectly reflect the energy levels and wavelengths of the emissions that were actually emitted from a piece of material. For example, although an element (e.g., titanium) may fluoresce x-rays at a specific energy level (e.g., 4.51 keV), an XRF detector may only have a resolution of 0.25 keV. Further, although the XRF detectors may detect a peak intensity at 4.50 keV for this element, the XRF detector also detects XRF at other energy levels in a distribution pattern around 4.50 keV.

An ROI for a particular element may be defined to represent a range of energy levels (or wavelengths) centered at the peak energy level (or peak wavelength) at which an element fluoresces x-rays (or emits optical photos). Pieces of material may be classified based on emissions characteristics within the ROI, for example, the number of energy counts detected within the ROI over a period of time.

The ROI vector may include a plurality of values, where each value represents one of the ROI for a spectrum. For example, each value may represent a number of counts detected within the region of interest. For example, if the ROI spans from 7.25 keV to 7.75 keV, then the value representing that ROI in the ROI vector will equal the number of energy counts detected between 7.25 and 7.75 keV for that spectrum.

In Act 1106, the ROI vector may be normalized using any of a variety of normalizing functions. For example, the ROI vector may be L1 or L-Infinity normalized. For example, using L1 normalizing, each ROI value may divided by the sum of all of the ROI values, whereas using L-Infinity normalizing, each ROI value may be divided by a maximum value. Normalizing the ROI vector may reduce the effects from variances in surface areas of the pieces of material that are sorted and the surface areas of the reference spectra. Further, normalizing the ROI vector also reduces the effects of variances in the irradiation flux of the one or more stimuli, variances in the fluorescent yield of each piece of material and reference sample, and variances in the acquisition times for pieces of material and reference samples.

In Act 1108, for each ROI of the ROI vector, a peak value of the ROI may be estimated. For example, a shaping function may be applied to the ROI value for each ROI in the ROI vector. Any of a variety of shaping functions may be used, for example, a Gaussian distribution function, a Poisson distribution function or another suitable function. If a Gaussian distribution function is used, then the Full Width Have Maximum (FWHM) technique may be used. By applying a shaping function to each ROI value, the peak value of a mature spectrum may be predicted (i.e., estimated) from the immature spectrum built from the detected first and second emissions. This technique for estimating a peak value for the ROI enables an accurate classification to be made for a piece of material even though the emissions were detected for the piece of material over a very brief period of time, as short as 10 milliseconds or less. Accordingly, pieces of material can be sorted at a much faster rate than they otherwise could be sorted. Further, by reducing an entire spectra of emissions data to a vector of values, namely a vector of estimated peaks, the amount of data that must be subsequently analyzed to classify the piece of material is substantially reduced. This reduction of data reduces the amount of computations that must subsequently be performed, which further increases the rate at which pieces can be sorted.

Is should be appreciated that the peak values of the ROI for reference spectra may be determined by stimulating and detecting a piece of the reference material over a relatively long period of time, e.g., five seconds. Such a long period of detection produces a relatively mature XRF and/or optical spectra for the reference material, from which the peak spectra can be measured or estimated as described above.

In Act 1110, the piece of material may be classified based on the estimated peak values using any of a variety of techniques. In one or more embodiments, the piece of material may be classified based on the estimated peak values at least similar to as described in the Sommer patent, step 59 of FIGS. 2A, 2B and 6. However, instead of calculating the root-mean-square for all energy levels within the one or more emissions spectra, the root-mean-square method could be applied only to the estimated peak values. In one or more alternative embodiments, the "distance method" or the "Tree method" described in U.S. Pat. No. 5,663,997, titled "Glass Composition Determination Method and Apparatus," by Willis et al. ("the Willis patent") may be used to classify the piece of material based on the estimated peak values. The "distance method" and the "Tree method" of the Willis patent are described in col. 7, line 8-col. 10, line 11 and in FIGS. 7A-7C, the contents of which are hereby incorporated by reference.

In one or more embodiments, classifying a piece of material, for example, based on estimated peaks, may involve the use of neural networks.

Methods 1000 and 1100 each may include additional acts. Further, the order of the acts performed as part of method 1000 is not limited to the order illustrated in FIG. 10 as the acts may be performed in other orders, and one or more of the acts of method 1000 may be performed in series or in parallel to one or more other acts, or parts thereof. For example, any of Acts 1002-1008 or parts thereof, may be performed in parallel for a given piece.

Methods 1000 and 1100 are merely illustrative embodiments of a methods of sorting and classifying respectively, pieces of material. Such illustrative embodiments are not intended to limit the scope of the invention, as any of numerous other implementations of classifying and sorting pieces of material, for example, variations of methods 1000 and 1100, are possible and are intended to fall within the scope of the invention.

Methods 1000 and 1100, acts thereof and various embodiments and variations of these methods and acts, individually or in combination, may be defined by computer-readable signals tangibly embodied on a computer-readable medium, for example, a non-volatile recording medium, an integrated circuit memory element, or a combination thereof. Such signals may define instructions, for example, as part of one or more programs, that, as a result of being executed by a computer, instruct the computer to perform one or more of the methods or acts described herein, and/or various embodiments, variations and combinations thereof. Such instructions may be written in any of a plurality of programming languages, for example, Java, Visual Basic, C, C#, or C++, Fortran, Pascal, Eiffel, Basic, COBOL, etc., or any of a variety of combinations thereof. The computer-readable medium on which such instructions are stored may reside on one or more of the components of module 216 described above, and may be distributed across one or more of such components.

The computer-readable medium may be transportable such that the instructions stored thereon can be loaded onto any computer system resource to implement the aspects of the present invention discussed herein. In addition, it should be appreciated that the instructions stored on the computer-readable medium, described above, are not limited to instructions embodied as part of an application program running on a host computer. Rather, the instructions may be embodied as any type of computer code (e.g., software or microcode) that can be employed to program a processor to implement the above-discussed aspects of the present invention.

It should be appreciated that any single component or collection of multiple components of a computer system, for example, the computer system described below in relation to FIGS. 12 and 13, that perform the functions described above in relation to methods 1000 and 1100 can be generically considered as one or more controllers that control the above-discussed functions. The one or more controllers can be implemented in numerous ways, such as with dedicated hardware, or using a processor that is programmed using microcode or software to perform the functions recited above.

It should be appreciated that any single component or collection of multiple components of a computer system, for example, the computer system described below in relation to FIGS. 12 and 13, that perform the functions described above with respect to describe or reference the method can be generically considered as one or more controllers that control the above-discussed functions. The one or more controllers can be implemented in numerous ways, such as with dedicated hardware, or using a processor that is programmed using microcode or software to perform the functions recited above.

Various embodiments according to the invention may be implemented on one or more computer systems. These computer systems, may be, for example, general-purpose computers such as those based on Intel PENTIUM-type processor, Motorola PowerPC, Sun UltraSPARC, Hewlett-Packard PA-RISC processors, or any other type of processor. It should be appreciated that one or more of any type computer system may be used to classify and sort pieces of material based on emissions resulting from one or more sources of stimuli according to various embodiments of the invention. Further, the software design system may be located on a single computer or may be distributed among a plurality of computers attached by a communications network.

A general-purpose computer system according to one embodiment of the invention is configured to classify and sort pieces of material based on emissions resulting from one or more sources of stimuli. It should be appreciated that the system may perform other functions, and the invention is not limited to having any particular function or set of functions.

Figure 12:
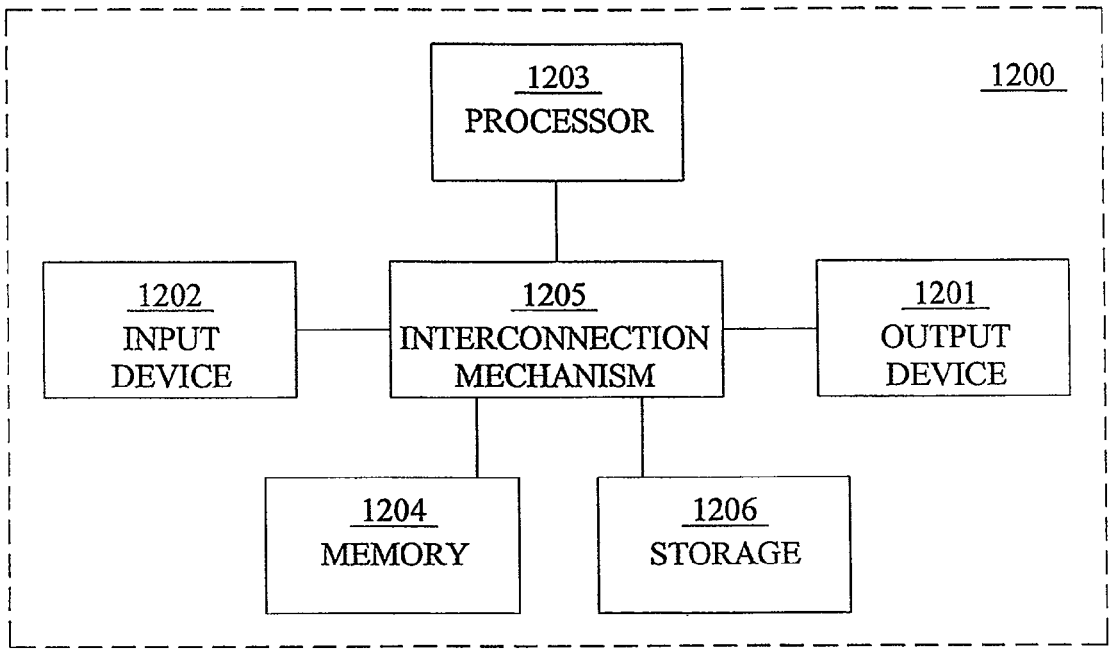
FIG. 12 is a block diagram illustrating an example of a computer system which can be used for one or more embodiments of the invention.

For example, various aspects of the invention may be implemented as specialized software executing in a general-purpose computer system 1200 such as that shown in FIG. 12. The computer system 1200 may include a processor 1203 connected to one or more memory devices 1204, such as a disk drive, memory, or other device for storing data. Memory 1204 is typically used for storing programs and data during operation of the computer system 1200. Components of computer system 1200 may be coupled by an interconnection mechanism 1205, which may include one or more busses (e.g., between components that are integrated within a same machine) and/or a network (e.g., between components that reside on separate discrete machines). The interconnection mechanism 1205 enables communications (e.g., data, instructions) to be exchanged between system components of system 1200. Computer system 1200 also includes one or more input devices 1202, for example, a keyboard, mouse, trackball, microphone, touch screen, and one or more output devices 1201, for example, a printing device, display screen, speaker. In addition, computer system 1200 may contain one or more interfaces (not shown) that connect computer system 1200 to a communication network (in addition or as an alternative to the interconnection mechanism AO5.

Figure 13:
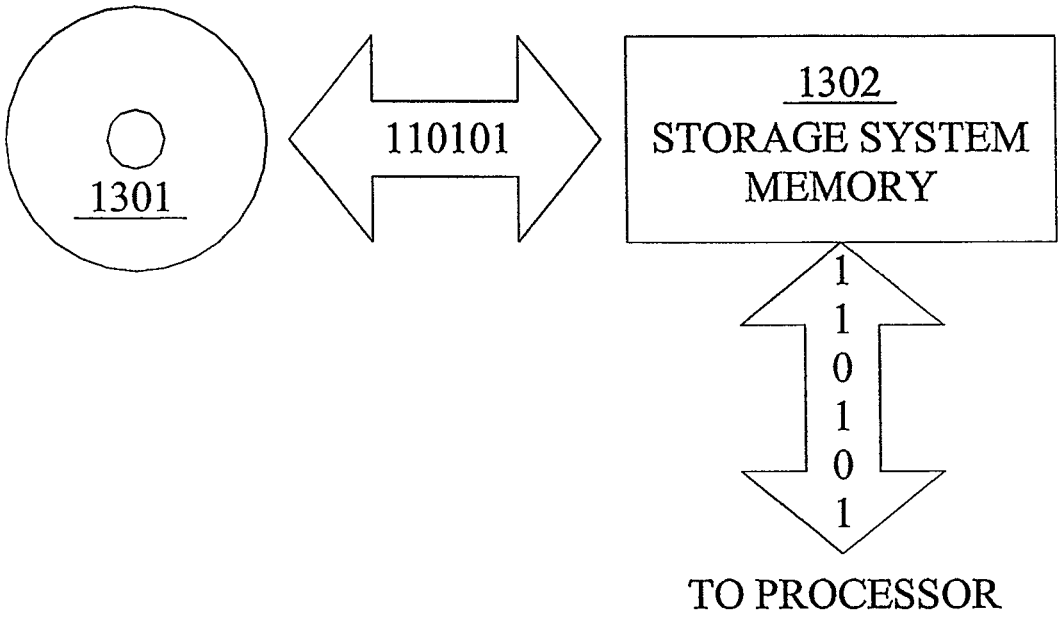
FIG. 13 is a block diagram illustrating an example of a memory system which can be used for one or more embodiments of the invention.

The storage system 1206, shown in greater detail in FIG. 13, typically includes a computer readable and writeable nonvolatile recording medium 1301 in which signals are stored that define a program to be executed by the processor or information stored on or in the medium 1301 to be processed by the program. The medium may, for example, be a disk or flash memory. Typically, in operation, the processor causes data to be read from the nonvolatile recording medium 1301 into another memory 1302 that allows for faster access to the information by the processor than does the medium 1301. This memory 1302 is typically a volatile, random access memory such as a dynamic random access memory (DRAM) or static memory (SRAM). It may be located in storage system 1206, as shown, or in memory system 1204, not shown. The processor 1203 generally manipulates the data within the integrated circuit memory 1204, 1302 and then copies the data to the medium 1301 after processing is completed. A variety of mechanisms are known for managing data movement between the medium 1301 and the integrated circuit memory element 1204, 1302, and the invention is not limited thereto. The invention is not limited to a particular memory system 1204 or storage system 1206.

The computer system may include specially-programmed, special-purpose hardware, for example, an application-specific integrated circuit (ASIC). Aspects of the invention may be implemented in software, hardware or firmware, or any suitable combination thereof. Further, such methods, acts, systems, system elements and components thereof may be implemented as part of the computer system described above or as an independent component.

Although computer system 1200 is shown by way of example as one type of computer system upon which various aspects of the invention may be practiced, it should be appreciated that aspects of the invention are not limited to being implemented on the computer system as shown in FIG. 12. Various aspects of the invention may be practiced on one or more computers having a different architecture or components that that shown in FIG. 12.

Computer system 1200 may be a general-purpose computer system that is programmable using a high-level computer programming language. Computer system 1200 may be also implemented using specially programmed, special purpose hardware. In computer system 1200, processor 1203 is typically a commercially available processor such as the well-known Pentium class processor available from the Intel Corporation. Many other processors are available. Such a processor usually executes an operating system which may be, for example, the Windows 95, Windows 98, Windows NT, Windows 2000 (Windows ME) or Windows XP operating systems available from the Microsoft Corporation, MAC OS System X available from Apple Computer, the Solaris Operating System available from Sun Microsystems, or UNIX available from various sources. Many other operating systems may be used.

The processor and operating system together define a computer platform for which application programs in high-level programming languages are written. It should be understood that the invention is not limited to a particular computer system platform, processor, operating system, or network. Also, it should be apparent to those skilled in the art that the present invention is not limited to a specific programming language or computer system. Further, it should be appreciated that other appropriate programming languages and other appropriate computer systems could also be used.

One or more portions of the computer system may be distributed across one or more computer systems (not shown) coupled to a communications network. These computer systems also may be general-purpose computer systems. For example, various aspects of the invention may be distributed among one or more computer systems configured to provide a service (e.g., servers) to one or more client computers, or to perform an overall task as part of a distributed system. For example, various aspects of the invention may be performed on a client-server system that includes components distributed among one or more server systems that perform various functions according to various embodiments of the invention. These components may be executable, intermediate (e.g., IL) or interpreted (e.g., Java) code which communicate over a communication network (e.g., the Internet) using a communication protocol (e.g., TCP/IP).

It should be appreciated that the invention is not limited to executing on any particular system or group of systems. Also, it should be appreciated that the invention is not limited to any particular distributed architecture, network, or communication protocol.

Various embodiments of the present invention may be programmed using an object-oriented programming language, such as SmallTalk, Java, C++, Ada, or C# (C-Sharp). Other object-oriented programming languages may also be used. Alternatively, functional, scripting, and/or logical programming languages may be used. Various aspects of the invention may be implemented in a non-programmed environment (e.g., documents created in HTML, XML or other format that, when viewed in a window of a browser program, render aspects of a graphical-user interface (GUI) or perform other functions). Various aspects of the invention may be implemented as programmed or non-programmed elements, or any suitable combination thereof.

As previously mentioned in this application, the classification module 930 may be configured to classify materials using any of a plurality of types of techniques, for example, as described in the Sommer patent in relation to step 59 in FIGS. 2a, 2b, and 6 of that patent. Included herein are FIGS. 2a, 2b, and 6 of that patent (renumbered as FIGS. 14A, 14B, and 15), which are now described.

FIGS. 14A and 14B is a flow chart depicting an exemplary illustrative embodiment of a process of sorting materials at high speeds. First, in step 1451, materials are fed in a singulated stream onto a conveyor belt. In an optional aspect of this illustrative embodiment, the materials are flattened with a flattening apparatus before being fed onto a conveyor belt. For example, a rolls crusher may be used for this purpose.

By flattening the piece of material, any other materials adhered to the piece of material may be removed. Further, flattening a piece of material before feeding the piece onto the conveyor belt improves sorting and classification of the materials. First, flattened pieces of material remain stationary on the conveyor belt, and do not roll. Thus, in the illustrative embodiment of FIG. 1 (of the Sommer patent), when a piece of material is classified, and an appropriate airjet is actuated, the piece is in a position anticipated by an xrf processing module, and the piece is ejected from the conveyor belt into an appropriate sorting bin. Second, flattening the pieces of material provides a larger surface area to irradiate and from which to detect x-rays. Consequently, the piece of material is bombarded with and fluoresces more x-rays, resulting in a more complete xrf spectrum being determined for the piece of material. Third, the composition of the piece of material is less influenced by surface contaminants. Because during flattening, fresh material surfaces are exposed, a cleaner xrf spectrum is to produced. Consequently, the spectra detected are more representative of the piece of material and not other materials that may be adhering to the surface of the piece of material.

In an illustrative embodiment, the conveyor belt (of the Sommer patent) is depressed or troughed in the center such that pieces of materials gravitate to the center of the conveyor belt, where they remain more stationary and may be aligned directly beneath a detector.

Next, in step 1453, the materials are conveyed along the conveyor belt and into an x-ray detection chamber. In an illustrative embodiment, each piece is flattened while being conveyed along the belt, as discussed above in connection with step 1451.

In an illustrative embodiment, the belt is comprised at least mostly of a material such as, for example, polyvinyl chloride (PVC), that when irradiated, fluoresce x-rays only at low energy levels. The speed at which the belt is operated is programmed in accordance with the spacing between the pieces of material and the cumulative time which it takes to: acquire or detect the x-rays from a piece of material; determine an xrf spectrum; and classify the piece. Such speeds may exceed 100 inches per second.

In step 1455, when a piece of material has entered the x-ray detection chamber, the piece is irradiated with x-rays. The exposure to x-rays causes each material to fluoresce x-rays at various energy levels, producing an xrf spectrum. In step 1457, this xrf spectrum is detected by an x-ray detector.

Next, in step 1459, for each piece of material, the material is classified based on the xrf that was detected.

Next, in step 1461 of FIG. 14B, an air jet corresponding to the classification of the piece is activated. Between the time at which the piece of material was irradiated and the time at which the air jet is activated, the piece of material has moved from the detection chamber to a point downstream from the detection chamber, at the rate of conveying of the belt. In an embodiment, the activation of the air jet is timed such that as the piece passes the air jet mapped to the classification of the piece, the air jet is activated and the piece of material is ejected from the conveyor belt.

In an alternative embodiment, the activation of air jet is timed by a respective position detector that detects when a piece of material is passing before the air jet and sends a signal to enable the activation of the jet. In step 1463, the sorting bin corresponding to the airjet that was activated receives the ejected piece of material.

The sorting application, also referred to herein as the classification module, executes a sorting algorithm that classifies the piece of material by recognizing the spectral pattern of the to xrf spectrum of the piece. FIG. 15 is a flow chart showing an illustrative embodiment of step 1459 of FIG. 14A for classifying the piece based on the xrf spectrum of the material. In step 1561, each energy count of the xrf spectrum is normalized such that each energy count may be considered a dimensional component of an xrf unit vector. Accordingly, each energy count is reduced by an amount equal to:

$$\frac{1}{\sqrt{(a^2+b^2+c^2\ldots\ n^2)}}$$

where a, b, c and n are energy counts at various energy levels.

The energy range of the xrf spectrum determined by a spectrum acquisition module, the number of energy levels of the determined xrf spectrum, and the resolution of the determined xrf spectrum are all programmable. These parameters may be chosen depending on the sort to be performed. If a large range of materials are being sorted, the energy range may be large and the number of energy levels high. If pieces of materials are to be sorted have relatively similar compositions, then the resolution may be fine, so as to distinguish between the spectral patterns. For example, when pieces of metal are to be sorted into aluminum, brass, chrome plated zinc, copper, stainless steel, and zinc, the spectrum acquisition module may be programmed to detect and count x-rays at 256 energy levels ranging from 0 key to 25.6 key with 0.1 key resolution.

Next, in step 1563, the vector dot products are computed between the normalized detected xrf spectrum and the normalized xrf spectra of any stored reference materials. Prior to starting the sorting process, a set of reference samples is collected and the xrf spectra of these samples determined and stored, for example, in a non-volatile storage medium. In an illustrative embodiment, for reference spectra, the x-ray spectrum of each reference material is collected over an interval of 5 seconds.

To compute the dot product, if the detected normalized reference spectra has normalized energy counts of $a_1, a_2, \ldots a_{256}$, and the normalized xrf spectrum of a reference material has normalized energy counts of $b_1, b_2, \ldots b_{256}$, then the vector dot product between these two spectra would be $a_1 \times b_1 + a_2 \times b_2 + \ldots a_{256} \times b_{256}$. Because all the spectra have been normalized to a unit vector, the dot products between two identical spectra would produce the value 1, where the results of all dot products should be between the 1 and 0. A dot product of 0 results if for every energy level of the detected spectrum for which at least a single count is to detected, the reference spectrum does not have a single energy count, or vice versa.

A user interface provides functions to sample, view, and compare individual spectrums to prepare the reference material set and to designate which references will be "active" and read into faster volatile memory for use during execution of the sorting algorithm. Thus, the xrf processing module computes a vector dot product between the normalized xrf of the detected material and the normalized xrf spectrum of each of the active reference materials.

Next, in step 1565, it is determined whether any of the computed vector dot products reach a minimum threshold value. In an illustrative embodiment, there is a single minimum threshold value that must be achieved for any of the reference spectra. In an alternative illustrative embodiment, each reference spectrum has an individual minimum threshold value that the dot product calculated for the reference spectrum must equal or exceed. Having an individual threshold value for each reference spectrum adds additional flexibility in distinguishing between similar spectral patterns, as is discussed in more detail below.

The threshold values for reference spectra are programmable by a system user. The closer the spectral patterns of two reference spectra, the higher the threshold value for these reference spectra should be programmed in order to positively distinguish the two spectra. For example, if a user is only interested in distinguishing between a first spectral pattern that has several peaks at certain energy levels, and a second spectral pattern that has energy peaks at certain other energy levels, then the user may program the threshold value for these two reference spectra to be relatively low to distinguish between the two spectral patterns (although the threshold value should be high enough to distinguish the two reference spectra from other reference spectra). Conversely, if two spectral patterns have energy peaks that share common energy levels and where, for these energy levels, the normalized count value for each spectra is close to the other, then the threshold value should be set relatively high. The value of the threshold must be set high enough so that the spectral pattern of a detected piece of material must be very close to matching one of the two reference spectra for a classification to be made. This high threshold ensures correct recognition of a spectral pattern.

If it is determined in step 1565 that at least one vector dot product reaches a minimum threshold value, then at step 1567 it is determined which computer dot product value has the highest value. The dot product of the highest value indicates the reference spectra closest to the detected spectra. In an alternative illustrative embodiment, where each spectrum has an individual threshold value, it is determined for which of the reference spectra the highest dot product was calculated for which the minimum threshold for the reference material was to reached.

Consequently, in step 1569, the classification corresponding to the stored spectrum that produced the highest dot product and equals or exceeds a minimum threshold is determined. Such a classification may be encoded on a classification signal. In an alternative illustrative embodiment of step 1569, the classification corresponding to the stored spectrum whose dot product exceeds the spectrum's threshold value by the greatest percentage is selected. For example, assume spectra A has a threshold of 0.4 and spectra B has a threshold of 0.6. In addition, assume a dot product of 0.7 is calculated for spectra A and a dot product of 0.8 is calculated for spectra B. The classification corresponding to Spectra A would be selected even though Spectra B's dot product is higher because Spectra A's dot product is 75% over its threshold, while Spectra B's dot product is only 33% over its threshold.

Classifying a piece of material by comparing the spectral shape or spectral pattern of the xrf of a spectrum contrasts to known methods of analyzing only energy counts of select peak energy levels. Such known methods merely determine whether the number of counts for select energy level exceeds a threshold value, or compare the counts of the select energy levels to the counts from corresponding select peak energy levels of a reference spectrum. Each selected energy level is typically indicative of a particular element present in the piece of material. In some known systems, the selected peaks are normalized, such that the resulting normalized peaks reflect the proportion of each element in the piece of material. Typically, known methods require that the xrf of a piece of material is detected over a relatively long period of time such as, for example, a second or more. Detecting over such a long period ensures that the selected peaks accurately reflect the proportion of each element.

The sorting algorithm described herein is a faster and more flexible method of classifying a piece of material than those known methods described above. First, comparing the spectral pattern or image of the detected xrf spectrum to the spectral pattern or image of stored reference spectra permits an accurate classification to be made even when only a faint or weak image of the xrf spectrum of a piece of material is known (i.e. the detected spectral pattern takes the general shape of the spectral pattern of a reference spectrum). Therefore, precise composition of a piece of material need not actually be determined (although it may be). Such a faint image results when a relatively limited number of x-rays or counts have been detected. Less counts result from shorter detection times. Thus, recognition of a faint image permits a piece of material to be classified in shorter detection times, substantially less than one second, possibly shorter than 10 ms.

Second, the sorting algorithm described herein permits a material sorting system to have greater flexibility in sorting materials than do known sorting algorithms allow. A user may select a random sample to use as a reference sample, establish the random sample as a reference spectra by detecting the xrf from the random sample for a relatively long interval of time, for example 5 seconds, in order to eliminate any random variations in the detected xrf, and store the xrf spectrum determined from the detected x-rays. The xrf spectrum of the random sample can then serve as a reference spectra by which other pieces of material can be detected and compared against to determine whether the determined xrf spectra matches the reference spectra created from the random sample. A user would not have to program the processing module to analyze certain peak energy levels of the new reference xrf spectrum and future determined xrf spectra. In contrast, the sorting algorithm would compare the spectral patterns without regard for peak energy levels. Known sorting methods require that sorting parameters be reconfigured to analyze the peak energy levels of the reference xrf spectra and determined xrf spectra.

Having now described some illustrative embodiments of the invention, it should be apparent to those skilled in the art that the foregoing is merely illustrative and not limiting, having been presented by way of example only. Numerous modifications and other illustrative embodiments are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments. Further, for the one or more means-plus-function limitations recited in the following claims, the means are not intended to be limited to the means disclosed herein for performing the recited function, but are intended to cover in scope any equivalent means, known now or later developed, for performing the recited function.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of" respectively, shall be closed or semi-closed transitional phrases, as set forth, with respect to claims, in the United States Patent Office Manual of Patent Examining Procedures (Original Eighth Edition, August 2001), to Section 2111.03.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A method of classifying material, wherein a number of potential classifications are available, the method comprising acts of:

(A) detecting x-rays fluoresced from the material;

(B) detecting optical emissions emitted from a plasma resulting from a vaporization of a portion of the material; and (C) classifying the material based on the detected x-rays and the detected optical emissions, including acts of (1) reducing the number of potential classifications by analyzing only a first one of two types of emissions: the detected x-rays or the detected optical emissions; and (2) selecting one of the reduced number of classifications by analyzing only a second one of the two types of emissions that was not analyzed in the act (C)(1);

wherein the act (C)(1) includes analyzing only the detected optical emissions and the act (C)(2) includes analyzing only the detected x-rays.

2. A method of classifying a piece of material, comprising acts of:

(A) irradiating the piece with x-ray photons to cause the piece to fluoresce x-rays;

(B) detecting x-rays fluoresced from the piece;

(C) vaporizing a portion of the piece to produce a plasma that emits optical emissions;

(D) detecting the optical emissions emitted from the piece;

(E) classifying the piece based on the detected x-rays and the detected optical emissions by first reducing a number of potential classifications using only the detected x-rays or the detected optical emissions and then selecting a final classification from among the reduced number of potential classifications using only whichever of the detected x-rays or detected optical emissions was not used in reducing the number of potential classifications;

(F) conveying the piece into an area in which two or more of the acts (A), (B), (C), (D) and (E) are performed;

(G) conveying the piece out of the area, wherein the act (F) includes conveying the piece on a first conveyor, and the act (G) includes conveying the piece on a second conveyor distinct from the first conveyor.

3. The method of claim 2, further comprising an act of:

(H) sorting the piece based on the classification.

4. The method of claim 2, wherein the act (B) is performed while the piece passes from the first conveyor to the second conveyor.

5. The method of claim 2, wherein the act (D) is performed while the piece passes from the first conveyor to the second conveyor.

6. The method of claim 2, wherein the act (A) is performed while the piece passes from the first conveyor to the second conveyor.

7. The method of claim 2, wherein the act (C) is performed while the piece passes from the first conveyor to the second conveyor.

8. The method of claim 2, wherein act (C) includes vaporizing the portion of the piece using a laser beam.

9. The method of claim 2, wherein act (C) includes vaporizing the portion of the piece using an electrical discharge.

10. The method of claim 2, wherein a predetermined number of potential classifications are available, and wherein the act (E) includes acts of:

(1) analyzing only the detected optical emissions to reduce the predetermined number to a reduced number of potential classifications; and (2) classifying the piece of material as one of the reduced number of classifications based on the detected x-rays.

11. The method of claim 10, wherein act (E)(1) includes determining that a threshold percentage of the detected optical emissions were emitted by one or more particular elements included within the piece.

12. The method of claim 11, wherein at least one of the one or more particular elements is a low-Z element.

13. The method of claim 12, wherein at least one of the one or more particular elements is magnesium.

14. The method of claim 12, wherein at least one of the one or more particular elements is silicon.

15. The method of claim 12, wherein at least one of the one or more particular elements is carbon.

16. The method of claim 12, wherein at least one of the one or more particular elements is aluminum.

17. The method of claim 10, wherein the reduced number of classifications represent a number of alloys belonging to a same alloy group.

18. The method of claim 17, wherein the alloy group is an aluminum alloy group.

19. The method of claim 2, wherein a predetermined number of potential classifications are available, and wherein the act (E) includes acts of:

(1) analyzing only the detected x-rays to reduce the predetermined number to the reduced number of potential classifications; and (2) classifying the piece of material as one of the reduced number of classifications based on the detected optical emissions.

20. The method of claim 2, wherein act (E) includes:

(1) creating one or more emissions spectra from the detected x-rays and detected optical emissions; and (2) estimating peak values for one or more regions of interest of the one or more spectra.

21. The method of claim 20, wherein act (E)(2) includes applying a shape fitting function to data corresponding to the one or more regions of interest.

22. The method of claim 2, wherein at least a portion of the material is in liquid or molten form.

23. The method of claim 2, wherein at least a portion of the material is in solid form.

24. The method of claim 2, wherein the material comprises a plurality of pieces of material in solid form, and the acts (A)-(G) are performed on the plurality of pieces.

25. The method of claim 2, wherein the act (E) comprises identifying a contaminant in the material.

26. A method of classifying material in a moving stream of materials, comprising acts of:

(A) detecting x-rays fluoresced from the material as the material moves;

(B) detecting optical emissions emitted from a plasma resulting from a vaporization of a portion of the material as the material moves; and (C) classifying the material based on the detected x-rays and/or the detected optical emissions, including (1) creating one or more emissions spectra from the detected x-rays and detected optical emissions; and (2) estimating peak values for one or more regions of interest of the one or more spectra, wherein (C) comprises reducing a number of potential classifications of the material by analyzing only a first one of the detected x-rays and the detected optical emissions, and then selecting one of the reduced number of potential classifications by considering only the type of emissions not considered in reducing the number of potential classifications.

27. The method of claim 26, wherein the act (C)(2) includes applying a shape-fitting function to data corresponding to the one or more regions of interest.

28. The method of claim 26, further comprising:

(D) based on the classification, sorting the material by removing the material from the stream to a location associated with the classification.

29. The method of claim 26, wherein at least a portion of the material is in liquid or molten form.

30. The method of claim 26, wherein at least a portion of the material is in solid form.

31. The method of claim 26, wherein the material comprises a plurality of pieces of material in solid form, and the acts (A)-(C) are performed on the plurality of pieces.

32. The method of claim 26, wherein the act (C) comprises identifying a contaminant in the material.

33. A method of classifying material, the method comprising acts of:

(A) applying an electrical discharge to vaporize a portion of the material to produce a plasma;

(B) detecting optical emissions emitted from the plasma;

(C) detecting x-rays fluoresced from the material; and (D) classifying the material based on the detected x-rays and/or the detected optical emissions, wherein a number of potential classifications are available, wherein the act (D) comprises:

(1) reducing the number of potential classifications by analyzing only a first one of two types of emissions: the detected x-rays or the detected optical emissions; and (2) selecting one of the reduced number of classifications by analyzing only a second one of the two types of emissions that was not analyzed in the act (D)(1).

34. The method of claim 33 wherein the act (D) includes creating one or more emissions spectra from the detected x-rays and detected optical emissions and estimating peak values for one or more regions of interest of the one or more spectra.

35. The method of claim 33, wherein the material is part of a moving stream of materials, further comprising acts of:

(E) based on the classification, sorting the material by removing the material from the stream to a location associated with the classification, wherein the acts (A)-(D) are performed as the material is moving.

36. The method of claim 33, wherein at least a portion of the material is in liquid or molten form.

37. The method of claim 33, wherein at least a portion of the material is in solid form.

38. The method of claim 33, wherein the material comprises a plurality of pieces of material in solid form, and the acts (A)-(D) are performed on the plurality of pieces.

39. The method of claim 33, wherein the act (D) comprises identifying a contaminant in the material.

40. A method of automated sorting of material in a stream of materials presented for sorting, comprising acts of:

(A) detecting x-rays fluoresced from the material as it moves;

(B) detecting optical emissions emitted from a plasma resulting from a vaporization of a portion of the material as it moves;

(C) classifying the material based on the detected x-rays and the detected optical emissions; and (D) based on the classification, sorting the material by removing the material from the stream to a location associated with the classification, wherein (C) comprises determining a first classification based on the detected x-rays or the detected optical emissions and then determining a second classification based on the other of the detected x-rays or the detected optical emissions not used to determine the first classification.

41. The method of claim 40, wherein the act (A) comprises conveying the material at a rate of at least 0.3 meter per second.

42. The method of claim 40, wherein the acts (A)-(D) are performed on materials of varying shapes and sizes.

43. The method of claim 40, wherein the acts (A), (B) and (C) are performed in less than one second.

44. The method of claim 40, wherein the act (C) comprises:

(1) creating one or more emissions spectra from the detected x-rays and the detected optical emissions; and (2) estimating peak values for one or more regions of interest of the one or more spectra.

45. The method of claim 40, wherein at least a portion of the material is in liquid or molten form.

46. The method of claim 40, wherein at least a portion of the material is in solid form.

47. The method of claim 40, wherein the material comprises a plurality of pieces of material in solid form, and the acts (A)-(E) are performed on the plurality of pieces.

48. The method of claim 40, wherein the act (C) comprises identifying a contaminant in the material.

49. A method of classifying material, wherein a number of potential classifications are available, the method comprising acts of:

(A) detecting x-rays fluoresced from the material;

(B) detecting optical emissions emitted from a plasma resulting from a vaporization of a portion of the material; and (C) classifying the material based on the detected x-rays and the detected optical emissions, including acts of (1) reducing the number of potential classifications by analyzing only a first one of two types of emissions: the detected x-rays or the detected optical emissions; and (2) selecting one of the reduced number of classifications by analyzing only a second one of the two types of emissions that was not analyzed in the act (C)(1);

wherein the act (C)(1) includes analyzing only the detected optical emissions and the act (C)(2) includes analyzing only the detected x-rays, wherein (C) involves use of immature emission spectra, and wherein (A)-(C)(2) is performed in less than one second, wherein the method further comprises automatically feeding multiple pieces of material including the material onto a conveyor configured to convey the material into an area in which (A)-(B) are performed and conveying the material out of the area.

50. The method of claim 49, wherein (A)-(C)(2) is performed in less than five hundred milliseconds.

51. The method of claim 49, wherein conveying the material into and out of the area comprises conveying the material at a rate of at least 0.3 meter per second.

52. The method of claim 51, wherein (A)-(B) are performed while the material is being conveyed.

53. The method of claim 49, wherein sorting the material comprises automatically discharging the material from a conveyor.

54. The method of claim 49, wherein the material has contaminants on its surface.

55. The method of claim 49, further comprising conveying the material from a first conveyor to a second conveyor separated by an air gap, and wherein (A) and/or (B) is performed while the material traverses the air gap.

56. The method of claim 55, wherein (A) comprises detecting the x-rays from underneath the material as it traverses the air gap.

57. The method of claim 49, further comprising collecting transmitted x-rays through the material and wherein (C) comprises classifying the material based on the transmitted x-rays.

58. The method of claim 49, further comprising creating one or more emissions spectra from the detected x-rays and detected optical emissions and estimating peak values for one or more regions of interest of the one or more spectra.

59. The method of claim 49, wherein the method further comprises irradiating the material with x-rays using an x-ray source positioned beneath the material.

60. The method of claim 59, wherein the method further comprises conveying the material, and wherein the material is irradiated with x-rays while the material is conveyed and wherein (A) is performed while the material is conveyed.

61. The method of claim 60, wherein the conveyor includes an opening, and wherein irradiating the material with x-rays using an x-ray source positioned beneath the material comprises irradiating the material with x-rays through the opening.

62. The method of claim 61, wherein the conveyor is a mesh conveyor comprising the opening, and wherein irradiating the material with x-rays using an x-ray source positioned beneath the material comprises irradiating the material with x-rays through the mesh conveyor.

63. The method of claim 60, wherein the conveyor comprises a window, and wherein irradiating the material with x-rays using an x-ray source positioned beneath the material comprises irradiating the material with x-rays through the window.

64. The method of claim 60, wherein conveying the material comprises conveying the material from a first conveyor to a second conveyor separated by an air gap, and wherein irradiating the material with x-rays using an x-ray source positioned beneath the material comprises irradiating the material as it traverses the air gap.

65. The method of claim 60, wherein conveying the material comprises conveying the material with a split conveyor belt, wherein the split conveyor belt comprises first and second conveyor belts arranged in parallel to each other and having an air gap therebetween.

66. A method of classifying material, wherein a number of potential classifications are available, the method comprising acts of:

(A) detecting x-rays fluoresced from the material;

(B) detecting optical emissions emitted from a plasma resulting from a vaporization of a portion of the material;

(C) detecting x-rays transmitted through the material; and (D) classifying the material based on the detected x-rays fluoresced from the material, the x-rays transmitted through the material, and the optical emissions, wherein (D) comprises (1) reducing the number of potential classifications by considering a subset of results from (A), (B), and (C); and (2) selecting one of the reduced number of classifications by analyzing a different subset of results of (A), (B), and (C).

67. The method of claim 66, wherein one or more of (A)-(C) are performed from below the material.

68. The method of 66, further comprising:

(E) irradiating the material with x-rays; and (F) irradiating the material with an optical source.

69. The method of claim 68, wherein one or more of (A), (B), (C), (E), and (F) are performed from below the material.

70. The method of claim 69, further comprising conveying the material.

71. The method of claim 70, wherein conveying the material comprises conveying the material with a mesh conveyor.

72. The method of claim 70, wherein conveying the material comprises conveying the material with a split conveyor belt, wherein the split conveyor belt comprises first and second conveyor belts arranged in parallel to each other and having an air gap therebetween.

73. The method of claim 70, wherein conveying the material comprises conveying the material on a conveyor having a window, and wherein performing one or more of (A), (B), (C), (E), and (F) from below the material comprises performing one or more of (A), (B), (C), (E), and (F) through the window.

74. The method of claim 70, wherein conveying the material comprises conveying the material from a first conveyor to a second conveyor separated by an air gap, and wherein performing one or more of (A), (B), (C), (E), and (F) from below the material comprises performing one or more of (A), (B), (C), (E), and (F) as the material traverses the air gap.

75. The method of claim 70, wherein (A) and (E) are performed from below the material and wherein (B), (C) and (F) are performed from above the material.

* * * * *

UNITED STATES PATENT AND TRADEMARK OFFICE

CERTIFICATE OF CORRECTION

PATENT NO. : 8,476,545 B2
APPLICATION NO. : 12/826315
DATED : July 2, 2013
INVENTOR(S) : Edward J. Sommer, Jr. et al.

It is certified that error appears in the above-identified patent and that said Letters Patent is hereby corrected as shown below:

In the Claims:

Claim 10, at column 38, line 12, delete "a reduced number" and replace it with --the reduced number--.

Signed and Sealed this
Fourteenth Day of January, 2014

Michelle K. Lee

Michelle K. Lee
*Deputy Director of the United States Patent and Trademark Office*